US009105227B2

(12) United States Patent
Ito

(10) Patent No.: US 9,105,227 B2
(45) Date of Patent: Aug. 11, 2015

(54) ELECTRO-OPTICAL DEVICE AND ELECTRONIC APPARATUS

(71) Applicant: SEIKO EPSON CORPORATION, Tokyo (JP)

(72) Inventor: Akihiko Ito, Tatsuno-machi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 195 days.

(21) Appl. No.: 13/686,999

(22) Filed: Nov. 28, 2012

(65) Prior Publication Data

US 2013/0135365 A1 May 30, 2013

(30) Foreign Application Priority Data

Nov. 30, 2011 (JP) ..... 2011-261718

(51) Int. Cl.

*G09G 3/22* (2006.01)
*G09G 3/00* (2006.01)
*G09G 3/36* (2006.01)

(52) U.S. Cl.

CPC ..... *G09G 3/22* (2013.01); *G09G 3/003* (2013.01); *G09G 3/3648* (2013.01); *G09G 3/3607* (2013.01); *G09G 3/3614* (2013.01); *G09G 2310/027* (2013.01); *G09G 2310/0224* (2013.01)

(58) Field of Classification Search

CPC ..... G09G 3/22; G09G 3/003; G09G 3/3648; G09G 3/3614; G09G 2310/0224; G09G 3/3607; G09G 2310/027

See application file for complete search history.

(56) References Cited

U.S. PATENT DOCUMENTS

2002/0033440 A1* 3/2002 Morita ..... 250/208.1
2006/0262198 A1* 11/2006 Une ..... 348/223.1
2007/0273686 A1* 11/2007 Watanabe et al. ..... 345/419
2008/0049049 A1* 2/2008 Park et al. ..... 345/690
2008/0152021 A1* 6/2008 Babonneau et al. ..... 375/240.29
2010/0026677 A1* 2/2010 Shikina et al. ..... 345/213
2010/0145585 A1* 6/2010 Gesnot et al. ..... 701/68
2010/0253668 A1* 10/2010 Sugihara et al. ..... 345/211
2010/0310127 A1* 12/2010 Ito ..... 382/103
2011/0018859 A1* 1/2011 Ito ..... 345/213
2011/0243439 A1* 10/2011 Albu et al. ..... 382/167
2011/0292172 A1* 12/2011 Harada ..... 348/43
2012/0007858 A1* 1/2012 Baek ..... 345/419
2012/0018518 A1* 1/2012 Strom et al. ..... 235/462.04
2012/0050295 A1* 3/2012 Tanaka ..... 345/467
2012/0146994 A1* 6/2012 Jeong et al. ..... 345/419
2013/0010006 A1 1/2013 Ito
2013/0010007 A1 1/2013 Ito
2013/0135365 A1* 5/2013 Ito ..... 345/690

FOREIGN PATENT DOCUMENTS

JP 2009-025436 A 2/2009

* cited by examiner

*Primary Examiner* — Aneeta Yodichkas
(74) *Attorney, Agent, or Firm* — Maschoff Brennan

(57) ABSTRACT

A plurality of pixels are arranged at each intersection of a plurality of scanning lines and a plurality of signal lines, and respectively includes a liquid crystal element displaying grayscales according to a grayscale potential of each signal line during the selection of each scanning line. To two pixels which are adjacent to each other in an extending direction of a signal line and correspond to two scanning lines selected by a scanning line driving circuit in each selection period, a signal line driving circuit supplies a grayscale potential according to a grayscale computed as the weighted average of grayscales designated by display data supplied to a display control circuit for each of the two pixels.

13 Claims, 16 Drawing Sheets

DISPLAY DATA

GRAYSCALE DESIGNATED IN UNIT PERIOD U1

GRAYSCALE DESIGNATED IN UNIT PERIOD U2

DISPLAY DATA

GRAYSCALE DESIGNATED IN UNIT PERIOD U1

GRAYSCALE DESIGNATED IN UNIT PERIOD U2

FIG. 12A
DISPLAY DATA
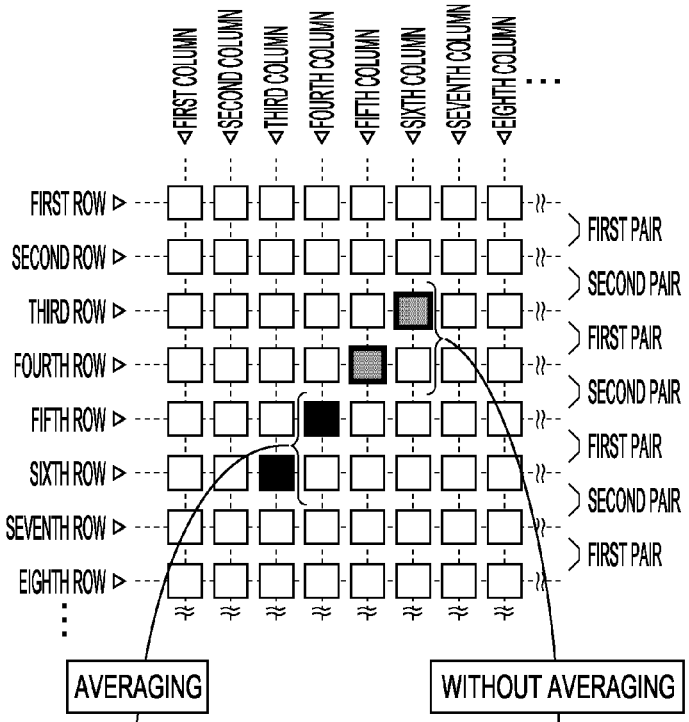
FIG. 12B
GRAYSCALE DESIGNATED IN UNIT PERIOD U1
FIG. 12C
GRAYSCALE DESIGNATED IN UNIT PERIOD U2
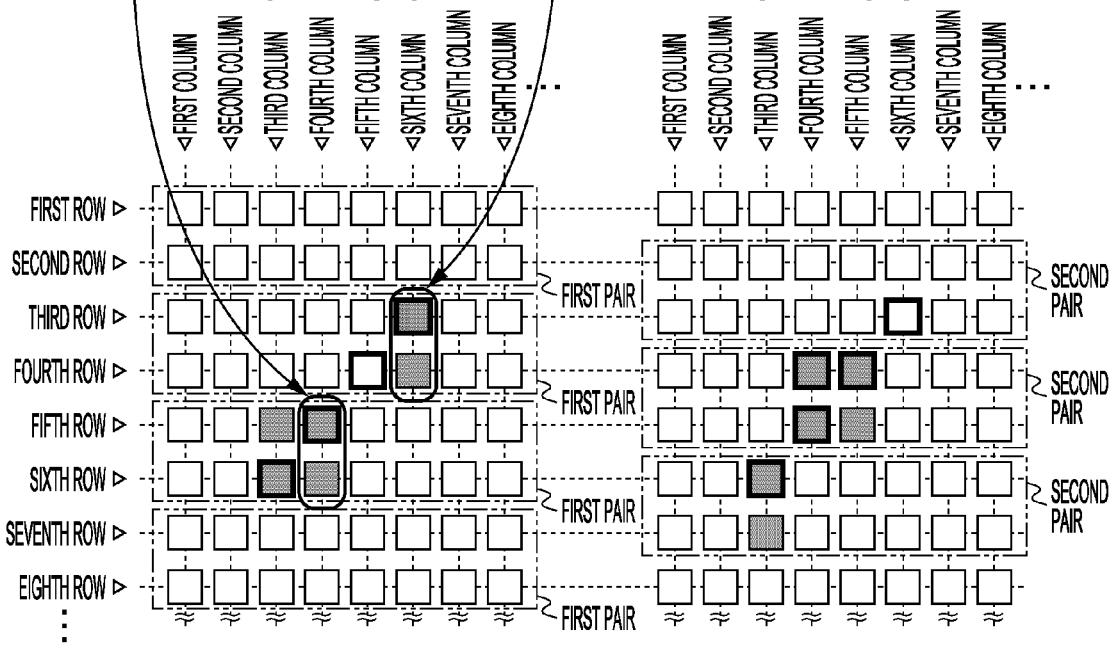

FIG. 13A
DISPLAY DATA
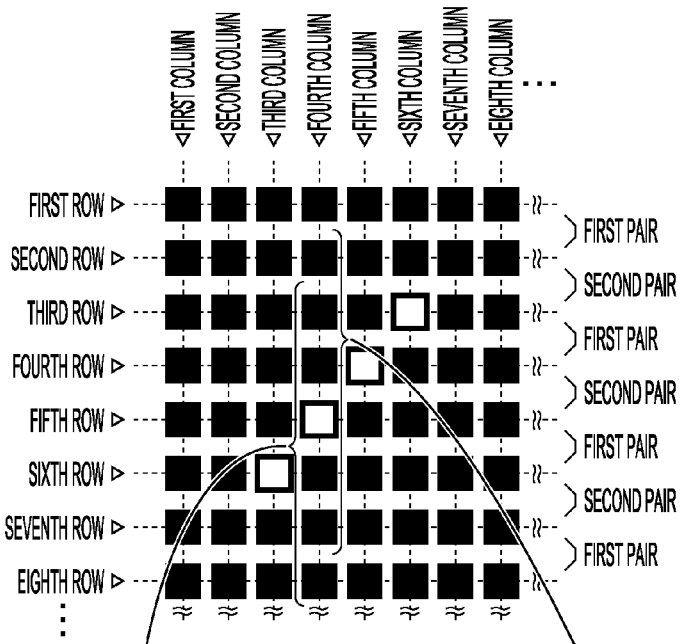
FIG. 13B
GRAYSCALE DESIGNATED IN UNIT PERIOD U1
FIG. 13C
GRAYSCALE DESIGNATED IN UNIT PERIOD U2
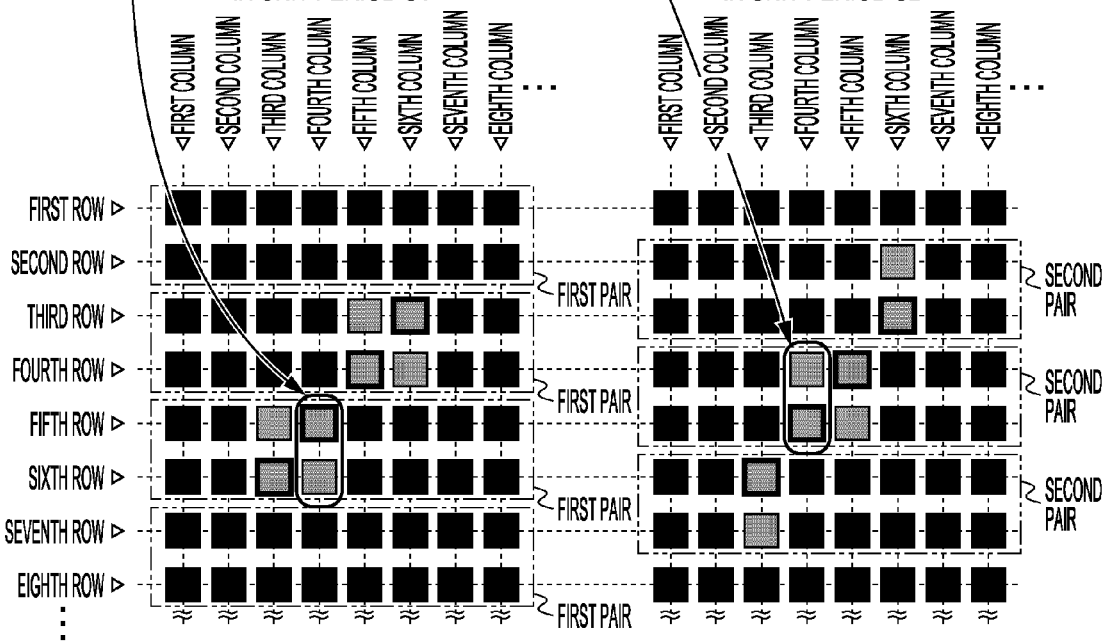

ELECTRO-OPTICAL DEVICE AND ELECTRONIC APPARATUS

BACKGROUND

1. Technical Field

The present invention relates to a technology for displaying a right-eye image and a left-eye image between which parallax is present so that an observer perceives a stereoscopic effect.

2. Related Art

A frame sequential type stereoscopic viewing method in which right-eye images and left-eye images are alternately displayed in a time division manner has been proposed in the related art. Since a right-eye image and a left-eye image are mixed in a period in which one of the right-eye image and the left-eye image turns into the other one, it is difficult for an observer to clearly recognize a stereoscopic effect during visual perception of an image (crosstalk). In order to solve the problem, for example, JP-A-2009-25436 discloses a technology for causing an observer not to visually perceive an image in a closed state of both the right-eye shutter and the left-eye shutter of a stereoscopic vision glasses during a period in which one of a right-eye image and a left-eye image turns into the other one (in other words, a period in which a right-eye image and a left-eye image are mixed).

Specifically, as shown in FIG. 18, a right-eye period corresponding to a right-eye image and a left-eye period corresponding to a left-eye image are alternately set. For the first half of the right-eye period, a display image is updated from the left-eye image to the right-eye image and the right-eye image is displayed for the latter half, and for the first half of the left-eye period, the display image is updated from the right-eye image to the left-eye image, and the left-eye image is displayed for the latter half. For the first halves of respective right-eye period and left-eye period, both of the right-eye shutter and the left-eye shutter are controlled to be in a closed state. Therefore, an observer does not perceive the mixture of the right-eye image and the left-eye image (crosstalk).

SUMMARY

However, in the stereoscopic (3D) display for alternately displaying a right-eye image and a left-eye image as in JP-A-2009-25436, since it is necessary to elevate the transfer speed of image signals and the operation speed of a driving circuit so as to make the frame frequency of image display two times or higher than planar (2D) display, there are problems of increases in the size of a driving circuit and manufacturing cost. An advantage of some aspects of the invention is to realize stereoscopic display without requiring elevation of an operation speed while suppressing the perception of the mixture of a right-eye image and a left-eye image by an observer.

According to a first aspect of the invention, there is provided an electro-optical device that alternately displays a right-eye image and a left-eye image in each display period, which includes a plurality of scanning lines that includes a plurality of first scanning lines and a plurality of second scanning lines that are alternately arranged, a plurality of signal lines that intersects with the plurality of scanning lines, a plurality of pixels each of which is disposed at each intersection of the plurality of scanning lines and the plurality of signal lines, a first driving circuit that, in respective display periods of a right-eye image and a left-eye image, sequentially selects scanning lines of a first pair including a first scanning line and a second scanning line out of the plurality of scanning lines which are adjacent to each other in each selection period of a first unit period of the display period, and sequentially selects scanning lines of a second pair including a first scanning line and a second scanning line which are adjacent to each other in a combination in which one of the scanning lines of the first pair selected in the first unit period straddles the second pair in each selection period of a second unit period after the elapse of the first unit period; and a second driving circuit to which display data indicating grayscales to be displayed in each of the plurality of pixels is supplied, and which, when a grayscale designated by the display data for a first pixel corresponding to each first scanning line is set to be a first grayscale and a grayscale designated by the display data for a second pixel corresponding to each second scanning line is set to be a second grayscale out of the scanning lines of the first pair and the scanning lines of the second pair selected by the first driving circuit in each of the selection periods, supplies a grayscale potential according to a grayscale computed as a weighted average of the first grayscale and the second grayscale to the first pixel and the second pixel.

In the above configuration, since every two scanning lines are sequentially selected in the first unit period of each display period and the grayscale potential is supplied to each pixel, this operation enables the further shortening of a period in which a right-eye image and a left-eye image are mixed in comparison to a configuration in which each of scanning lines are sequentially selected and a grayscale potential is supplied to each pixel in each display period. Thus, even when perception of the mixture of a right-eye image and a left-eye image by an observer is suppressed by controlling both of a right-eye shutter and a left-eye shutter of stereoscopic vision glasses to be in a closed state during the period in which the right-eye image and the left-eye image are mixed, the brightness of a display image can be enhanced.

In addition, since every two scanning lines are selected in each of the first unit period and the second unit period, it is not necessary to further elevate the transfer speed of an image signal of a right-eye image and a left-eye image and the operation speed of driving circuits (a scanning line driving circuit and a signal line driving circuit) in comparison to those in planar (2D) display. Thus, there is an advantage in that stereoscopic display can be realized using a driving circuit having the same operation speed as that of a driving circuit used for a planar image (in other words, the scale of the driving circuit and the manufacturing cost can be reduced).

Resolution of a display image in each of the first unit period and the second unit period is degraded, but a grayscale potential according to a designated grayscale for each pixel corresponding to a first scanning line is supplied to each pixel of a first pair in each selection period of the first unit period, and a grayscale potential according to a designated grayscale for each pixel corresponding to a second scanning line is supplied to each pixel of a second pair which one of scanning lines of the first pair straddles in each selection period of the second unit period after the elapse of the first unit period. Thus, there is also another advantage in that the degradation of resolution of a display image in each unit period is difficult to be perceived by an observer.

Further, to a first pixel and a second pixel, a grayscale potential according to a grayscale computed as the weighted average of a first grayscale and a second grayscale is supplied. Accordingly, a pixel can reduce the difference between a grayscale designated in the first unit period and a grayscale designated in the second unit period. In other words, there is an advantage in that a pixel can reduce the possibility that an observer perceives the difference between the grayscale designated in the first unit period and the grayscale designated in the second unit period as "flickering".

In addition, it is preferable in the above-described electro-optical device that, in an arithmetic operation of the weighted average, a first weighting coefficient given to the first grayscale and a second weighting coefficient given to the second grayscale be greater than 0.

According to the aspect of the invention, since the grayscale potential according to the grayscale computed as the weighted average of the first grayscale and the second grayscale is supplied to the first pixel and the second pixel, there is an advantage in that "flickering" caused by changes in a grayscale displayed by a pixel can be suppressed.

In addition, it is preferable in the above-described electro-optical device that the first weighting coefficient and the second weighting coefficient be an equal value.

According to the aspect of the invention, since the grayscale potential according to the grayscale computed as the (simple) average of the first grayscale and the second grayscale is supplied to the first pixel and the second pixel, there is an advantage in that "flickering" caused by changes in a grayscale displayed by a pixel can be suppressed.

In addition, it is preferable in the above-described electro-optical device that, when the display data has the average value of grayscales designated for each of a predetermined number of pixels including the first pixel and the second pixel as an average grayscale, if the difference between the first grayscale and the average grayscale is greater than the difference between the second grayscale and the average grayscale, the first weighting coefficient be set to be a value greater than the second weighting coefficient, and if the difference between the first grayscale and the average grayscale is smaller than the difference between the second grayscale and the average grayscale, the first weighting coefficient be set to be a value smaller than the second weighting coefficient.

According to the aspect of the invention, the grayscales displayed by a first pixel and a second pixel are controlled based on the relationship between the grayscales designated by display data for the first pixel and the second pixel and the grayscales designated by the display data for the predetermined number of pixels that are present in the periphery of the first pixel and the second pixel. Accordingly, it is possible to display a clear-cut image that is close to an image expressed by the display data.

In addition, according to a second aspect of the invention, there is provided an electro-optical device which includes a plurality of scanning lines that includes a plurality of first scanning lines and a plurality of second scanning lines that are alternately arranged, a plurality of signal lines that intersects with the plurality of scanning lines, a plurality of pixels each of which is disposed at each intersection of the plurality of scanning lines and the plurality of signal lines, a first driving circuit that, in respective display periods of a right-eye image and a left-eye image, sequentially selects scanning lines of a first pair including a first scanning line and a second scanning line out of the plurality of scanning lines which are adjacent to each other in each selection period of a first unit period of the display period, and sequentially selects scanning lines of a second pair including a first scanning line and a second scanning line which are adjacent to each other in a combination in which one of the scanning lines of the first pair selected in the first unit period straddles the second pair in each selection period of a second unit period after the elapse of the first unit period, and a second driving circuit to which display data indicating grayscales to be displayed in each of the plurality of pixels is supplied, and which, when a grayscale designated by the display data for a first pixel corresponding to each first scanning line is set to be a first grayscale, a grayscale designated by the display data for a second pixel corresponding to each second scanning line is set to be a second grayscale out of the scanning lines of the first pair and the scanning lines of the second pair selected by the first driving circuit in each of the selection periods, and the average value of grayscales designated by the display data for each of a predetermined number of pixels including the first pixel and the second pixel is set to be an average grayscale, supplies a grayscale potential according to a grayscale computed by multiplying the average value of the first grayscale and the second grayscale by a grayscale control coefficient determined based on the first grayscale, the second grayscale, and the average grayscale to the first pixel and the second pixel.

According to the aspect of the invention, the grayscales displayed by a first pixel and a second pixel are controlled using a grayscale control coefficient determined based on the relationship between the grayscales designated by the display data for the first pixel and the second pixel and the grayscales designated by the display data for the predetermined number of pixels that are present in the periphery of the first pixel and the second pixel. Accordingly, it is possible to display a clear-cut image that is close to an image expressed by the display data.

In addition, it is preferable in the above-described electro-optical device that, when the difference between the first grayscale and the average grayscale is greater than the difference between the second grayscale and the average grayscale, the grayscale control coefficient be set to be a value greater than 1 if the first grayscale is greater than the average grayscale, and the grayscale control coefficient be set to be a value greater than 0 and smaller than 1 if the first grayscale is smaller than the average grayscale, and when the difference between the second grayscale and the average grayscale is greater than the difference between the first grayscale and the average grayscale, the grayscale control coefficient be set to be a value greater than 1 if the second grayscale is greater than the average grayscale, and the grayscale control coefficient be set to be a value greater than 0 and smaller than 1 if the second grayscale is smaller than the average grayscale.

According to the aspect of the invention, the grayscale control coefficient is determined so that the difference between the grayscales displayed by the first pixel and the second pixel and the grayscales designated by the display data for the predetermined number of pixels that are present in the periphery of the first pixel and the second pixel becomes great. Accordingly, it is possible to display a clear-cut image that is close to an image expressed by the display data.

In addition, it is preferable in the above-described electro-optical device that the predetermined number of pixels include at least one or more pixels which are adjacent to the second pixel on the opposite side of an extending direction of the first pixel and a signal line, and at least one or more pixels which are adjacent to the first pixel on the opposite side of an extending direction of the second pixel and a signal line.

According to the aspect of the invention, since the grayscales displayed by a first pixel and a second pixel are determined in consideration of the grayscales designated by the display data for the predetermined number of pixels that are present in the periphery of the first pixel and the second pixel, it is possible to display a clear-cut image.

In addition, according to a third aspect of the invention, there is provided an electro-optical device that alternately displays a right-eye image and a left-eye image in each display period, which includes a plurality of scanning lines that includes a plurality of first scanning lines and a plurality of second scanning lines that are alternately arranged, a plurality of signal lines that intersects with the plurality of scanning lines, a plurality of pixels each of which is disposed at each intersection of the plurality of scanning lines and the plurality of signal lines, a first driving circuit that, in respective display periods of a right-eye image and a left-eye image, sequentially selects scanning lines of a first pair including a first scanning line and a second scanning line out of the plurality of scanning lines which are adjacent to each other in each selection period of a first unit period of the display period, and sequentially selects scanning lines of a second pair including a first scanning line and a second scanning line which are adjacent to each other in a combination in which one of the scanning lines of the first pair selected in the first unit period straddles the second pair in each selection period of a second unit period after the elapse of the first unit period, and a second driving circuit to which display data indicating grayscales to be displayed in each of the plurality of pixels is supplied, and which, when a grayscale designated by the display data for a first pixel corresponding to each first scanning line is set to be a first grayscale, a grayscale designated by the display data for a second pixel corresponding to each second scanning line is set to be a second grayscale out of the scanning lines of the first pair and the scanning lines of the second pair selected by the first driving circuit in each of the selection periods, and the difference between the first grayscale and the second grayscale is greater than a predetermined threshold value, supplies a grayscale potential according to a grayscale computed as the weighted average of the first grayscale and the second grayscale to the first pixel and the second pixel, and when the difference between the first grayscale and the second grayscale is equal to or smaller than the predetermined threshold value, supplies a grayscale potential according to the first grayscale to the first pixel and the second pixel.

According to the aspect of the invention, when the difference between a first grayscale and a second grayscale is greater than a predetermined threshold value, a grayscale potential according to a grayscale computed as the weighted average of the first grayscale and the second grayscale is supplied to a first pixel and a second pixel. Accordingly, there is an advantage in that a pixel can reduce the difference between a grayscale designated in a first unit period and a grayscale designated in a second unit period, and "flickering" caused by changed in a grayscale displayed by a pixel can be suppressed.

In addition, it is preferable for the above-described electro-optical device which displays a right-eye image and a left-eye image stereoscopically viewed using stereoscopic vision glasses including a right-eye shutter and a left-eye shutter to further include a glasses control circuit that controls both of the right-eye shutter and the left-eye shutter to be in a closed state during a period at least including a portion of the first unit period of each of the display periods, controls the right-eye shutter to be in an open state and the left-eye shutter to be in a closed state during a period at least including a portion of the second unit period in each display period of the right-eye image, and controls the left-eye shutter to be in an open state and the right-eye shutter to be in a closed state during a period at least including a portion of the second unit period in each display period of the left-eye period.

According to the aspect of the invention, it is possible to suppress the perception of the mixture of a right-eye image and a left-eye image by an observer by controlling both of the right-eye shutter and the left-eye shutter of the stereoscopic vision glasses to be in a closed state during a period in which the right-eye image and the left-eye image are mixed.

In addition, it is preferable in the above-described electro-optical device that, in each of a plurality of control periods including a display period of a right-eye image and a display period of a left-eye image which are consecutive, the first driving circuit sequentially select the scanning lines of the first pair including a first scanning line and a second scanning line out of the plurality of scanning lines which are adjacent to each other in each selection period of the first unit period of each of the display periods, and sequentially select the scanning lines of the second pair including a first scanning line and a second scanning line out of the plurality of scanning lines which are adjacent to each other in a combination in which one of the scanning lines of the first pair straddles the second pair in each selection period of a second unit period of each of the display periods, and, in a first control period of each of the display periods in the plurality of control periods, the second driving circuit set the polarity of the grayscale potential with respect to a reference voltage to be a first polarity in the first unit period of each of the display periods and to be a second polarity that is the opposite polarity to the first polarity in the second unit period of each of the display periods, and, in a second control period immediately after the first control period of the plurality of control periods, set the polarity of the grayscale potential with respect to the reference potential to be the second polarity in the first unit period of each of the display periods and to be the first polarity in the second unit period of each of the display periods.

According to the aspect of the invention, since a length of time in which a grayscale potential according to a designated grayscale for a right-eye image or a left-eye image is set to be the positive polarity and a length of time in which the grayscale potential is set to be the negative polarity are uniformized, there is an advantage in that application of a direct current voltage to a pixel can be suppressed.

In addition, it is preferable in the above-described electro-optical device that, in a first control period of a plurality of control periods including a display period of a right-eye image and a display period of a left-eye image which are consecutive, the first driving circuit sequentially select the scanning lines of the first pair including a first scanning line and a second scanning line out of the plurality of scanning lines which are adjacent to each other in each selection period of the first unit period of each of the display periods, and sequentially select scanning lines of the second pair including a first scanning line and a second scanning line out of the plurality of scanning lines which are adjacent to each other in a combination in which one of the scanning lines of the first pair straddles the second pair in each selection period of the second unit period of each of the display periods, and in a second control period immediately after the first control period of the plurality of selection periods, sequentially select the scanning lines of the second pair in each selection period of the first unit period of each of the display periods, and sequentially select the scanning lines of the first pair in each selection period of the second unit period of each of the display periods, and the second driving circuit set the polarity of the grayscale potential with respect to the reference potential to be a first polarity in the first unit period of each of the display periods, and set the polarity of the grayscale potential to be a second polarity that is the opposite polarity to the first polarity in the second unit period of each of the display periods in each of the plurality of control periods.

According to the aspect of the invention, since a length of time in which a grayscale potential according to a designated grayscale for a right-eye image or a left-eye image is set to be the positive polarity and a length of time in which the grayscale potential is set to be the negative polarity are uniformized, there is an advantage in that application of a direct current voltage to a pixel can be suppressed. In addition, since the polarity of a grayscale potential is reversed in every unit period, there is an advantage in that "flickering" caused by the difference between the polarities of the grayscale potential is difficult to be perceived by an observer.

The electro-optical device according to each aspect above is employed in various kinds of electronic apparatuses. For example, an electro-optical device according to each aspect above and a stereoscopic display device including stereoscopic vision glasses controlled by a glasses control circuit are exemplified as an electronic apparatus of the invention.

BRIEF DESCRIPTION OF THE DRAWINGS

The invention will be described with reference to the accompanying drawings, wherein like numbers reference like elements.

FIGS. 12A to 12C are illustrative diagrams indicating display data and grayscales to be displayed which are supplied to a stereoscopic display device according to a third modification example.

FIGS. 13A to 13C are illustrative diagrams indicating display data and grayscales to be displayed which are supplied to a stereoscopic display device according to a fourth modification example.

DESCRIPTION OF EXEMPLARY EMBODIMENTS

First Embodiment

Figure 1:
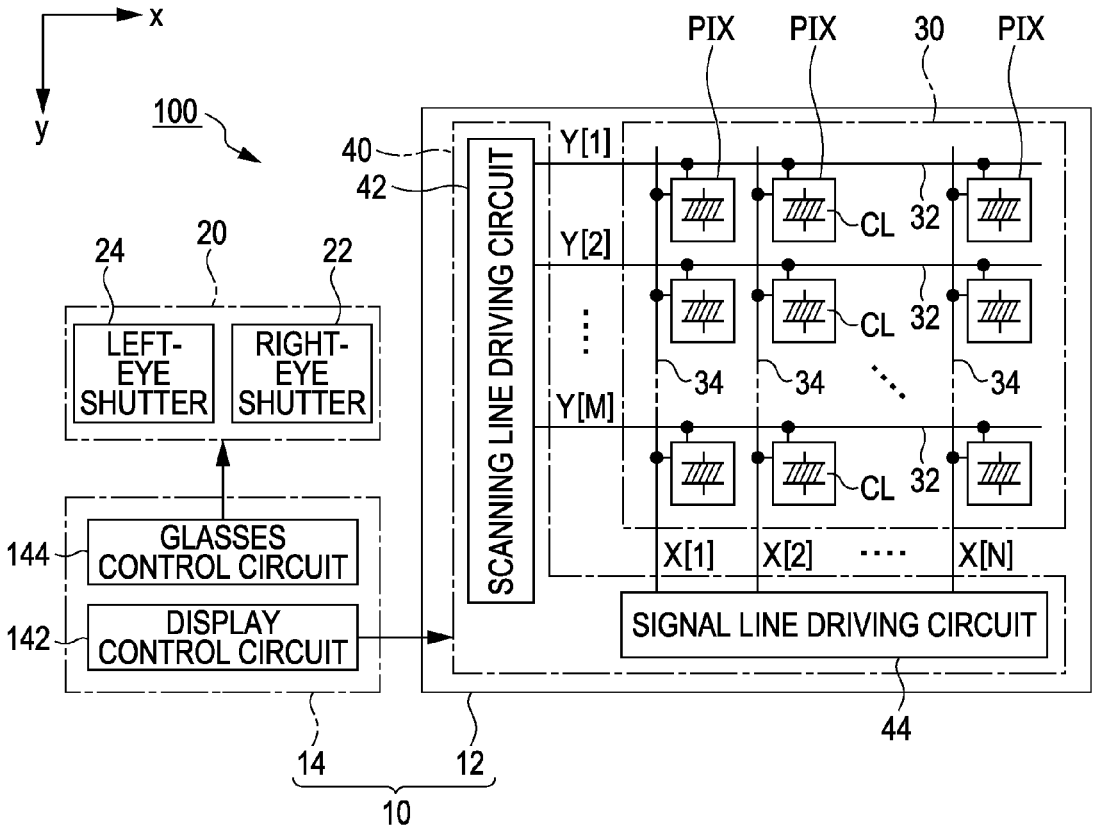
FIG. 1 is a block diagram of a stereoscopic display device according to a first embodiment of the invention.

FIG. 1 is a block diagram of a stereoscopic display device 100 according to a first embodiment of the invention. The stereoscopic display device 100 is an electronic device which displays a stereoscopic image of which a stereoscopic effect can be perceived by an observer using an active shutter scheme, and includes an electro-optical device 10 and stereoscopic vision glasses 20. The electro-optical device 10 alternately displays a right-eye image GR and a left-eye image GL between which parallax is present in a time division manner.

The stereoscopic vision glasses 20 is glass-type instrument with which an observer is equipped when he or she visually perceives a stereoscopic image displayed by the electro-optical device 10, and includes a right-eye shutter 22 positioned in front of the right eye of the observer and a left-eye shutter 24 positioned in front of the left eye of the observer. Each of the right-eye shutter 22 and the left-eye shutter 24 is controlled to be in an open state in which radiated light is transmitted therethrough (transmission state) and a closed state in which radiated light is blocked (light-blocking state). For example, a liquid crystal shutter by which one of the open state and the closed state turns into the other one by changing the alignment direction of the liquid crystal according to an applied voltage can be employed as the right-eye shutter 22 and the left-eye shutter 24.

The electro-optical device 10 of FIG. 1 includes an electro-optical panel 12 and a control circuit 14. The electro-optical panel 12 has a pixel unit 30 in which a plurality of pixels (pixel circuits) PIX are arranged and a driving circuit 40 which drives each pixel PIX. In the pixel unit 30, M scanning lines 32 which extend in the x direction and N signal lines 34 which extend in the y direction which intersects with the x direction (in which M and N are natural numbers) are formed. The plurality of pixels PIX in the pixel unit 30 are arranged in a matrix form with M rows in the vertical direction×N columns in the horizontal direction corresponding to each intersection of the scanning lines 32 and the signal lines 34.

The driving circuit 40 includes a scanning line driving circuit 42 and a signal line driving circuit 44. The scanning line driving circuit 42 sequentially selects each scanning line 32 with supply of scanning signals Y[1] to Y[M] corresponding to each of the scanning lines 32. By setting a scanning signal Y[m] (m=1 to M) to be a predetermined selection potential, the m-th scanning line 32 is selected. The signal line driving circuit 44 supplies grayscale potentials X[1] to X[N] to each of N signal lines 34 in synchronization with the selection of a scanning line 32 by the scanning line driving circuit 42. A grayscale potential X[n] (n=1 to N) is set to change according to a grayscale designated by an image signal G (a right-eye image GR and a left-eye image GL) for each pixel PIX. The polarity of a grayscale potential X[n] with respect to a predetermined reference potential is periodically reversed.

Figure 2:
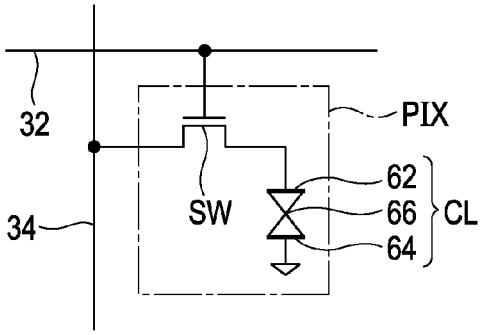
FIG. 2 is a circuit diagram of a pixel circuit.

FIG. 2 is a circuit diagram of each pixel PIX. As shown in FIG. 2, each pixel PIX has a liquid crystal element CL and a selection switch SW. The liquid crystal element CL is an electro-optical element that includes a pixel electrode 62 and a common electrode 64 which face each other, and a liquid crystal 66 between both electrodes. According to a voltage applied between the pixel electrode 62 and the common electrode 64, the transmittance (display grayscale) of the liquid crystal 66 changes. The selection switch SW includes an N-channel-type thin-film transistor in which the gate thereof is connected to a scanning line 32, and controls electric connection (conduction and insulation) of both of the liquid crystal element CL and a signal line 34 while being interposed therebetween. By setting a scanning signal Y[m] to be a selection potential, the selection switch SW in each pixel PIX of the m-th row is switched to be an on state at the same time. Each pixel PIX (liquid crystal element CL) displays a grayscale according to a grayscale potential X[n] of a signal line 34 when the selection switch SW is controlled to be an on state (in other words, when a scanning line 32 is selected). Note that a configuration in which an auxiliary capacitor is connected in parallel with the liquid crystal element CL can also be employed.

The control circuit 14 of FIG. 1 includes a display control circuit 142 that controls the electro-optical panel 12 and a glasses control circuit 144 that controls the stereoscopic vision glasses 20. Note that a configuration in which the display control circuit 142 and the glasses control circuit 144 are mounted in a single integrated circuit or a configuration in which the display control circuit 142 and the glasses control circuit 144 are distributed in separate integrated circuits can be employed.

The display control circuit 142 is supplied with display data V which designates the grayscale of each pixel PIX from an external circuit. The display control circuit 142 generates an image signal G (the right-eye image GR or the left-eye image GL) based on the display data V. Specifically, the display control circuit 142 includes a delay circuit and an arithmetic circuit. The delay circuit delays the display data V by a period corresponding to one horizontal scanning period, and outputs the delayed data. Thus, the output from the delay circuit is data for designating the grayscale of a pixel PIX adjacent to a pixel PIX in the y direction of which the grayscale is designated by the display data V. The arithmetic circuit executes an arithmetic operation for obtaining the average (or the weighted average) of the display data V and the output from the delay circuit, and outputs the arithmetic operation result as an image signal G.

In addition, the display control circuit 142 controls the driving circuit 40 so that the right-eye image GR and the left-eye image GL between which parallax is present are displayed in the pixel unit 30 in a time division manner. Specifically, the display control circuit 142 controls the driving circuit 40 so that the driving circuit 40 executes the following operation.

Figure 3:
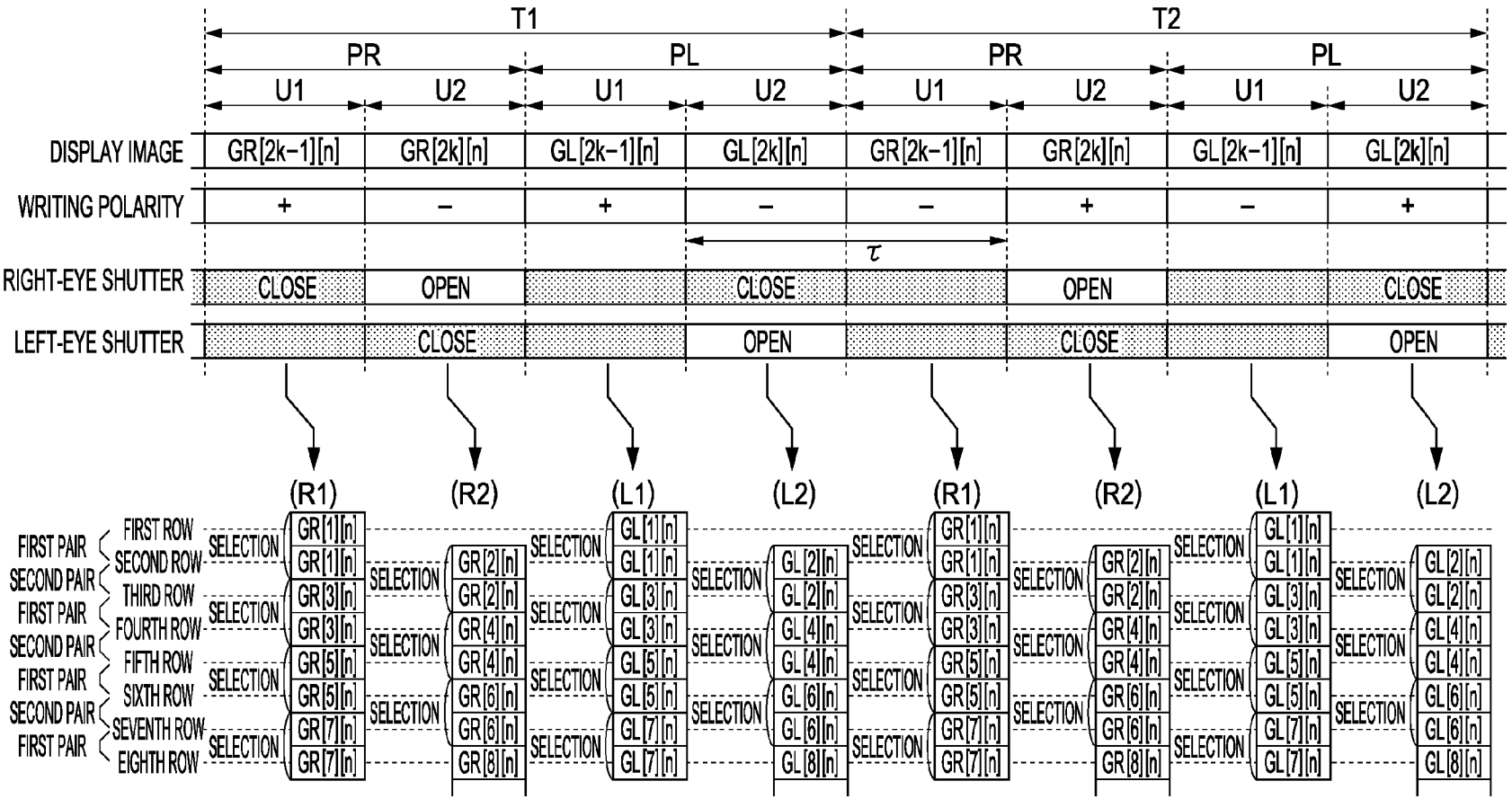
FIG. 3 is an illustrative diagram of an operation of a stereoscopic display device.

FIG. 3 is an illustrative diagram of an operation of the electro-optical device 10. An operation period of the electro-optical device 10 is divided into a plurality of control periods T (T1 and T2). The control period T1 and the control period T2 are alternately arranged on the time axis. Each control period T (T1 and T2) is divided into two display periods P with a predetermined length (a right-eye display period PR and a left-eye display period PL). In the right-eye display period PR, the right-eye image GR is displayed in the pixel unit 30, and in the left-eye display period PL, the left-eye image GL is displayed in the pixel unit 30. The right-eye display period PR and the left-eye display period PL are alternately arranged on the time axis. In other words, two display periods P (a pair of the right-eye display period PR and the left-eye display period PL) positioned before and after constitute one control period T (T1 and T2). Each display period P (PR or PL) is divided into two unit periods U (U1 and U2) with lengths of time equal to each other. The unit period U2 succeeds the unit period U1.

Figure 4:
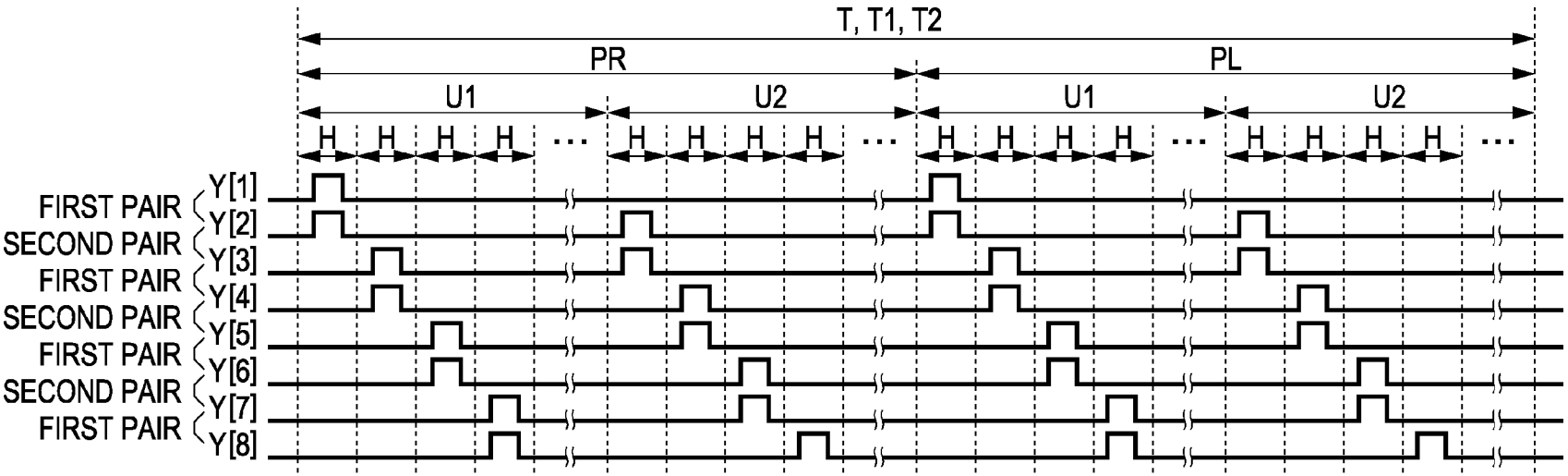
FIG. 4 is an illustrative diagram of an operation of a scanning line driving circuit.

FIG. 4 is an illustrative diagram of an operation of the scanning line driving circuit 42 (first driving circuit) in each display period P (PR and PL). As shown in FIG. 4, in the unit period U1 of each display period P, the scanning line driving circuit 42 sequentially selects each of plural pairs obtained by dividing M scanning lines 32 into respective two lines which are adjacent to each other (hereinafter, referred to as a "first pair") for each selection period H. The first pair is composed of one scanning line 32 in an even-numbered row (a (2k)-th row) and one scanning line 32 in an odd-numbered row (a (2k−1)-th row) adjacent to the foregoing scanning line 32 in the negative side of the y direction (in which k is a natural number).

The scanning line driving circuit 42 simultaneously selects a first pair of two scanning lines 32 by setting a scanning signal Y[2k−1] and a scanning signal Y[2k] in one selection period H in the unit period U1 to have a selected potential. For example, in a first selection period H in the unit period U1, two scanning lines 32 in the first and the second rows are simultaneously selected, and in a second selection period H in the unit period U1, two scanning lines 32 of the third and the fourth rows are simultaneously selected.

In the unit period U2 of each display period P, the scanning line driving circuit 42 sequentially selects each of plural pairs obtained by dividing M scanning lines 32 into respective two lines which are adjacent to each other (hereinafter, referred to as a "second pair") for each selection period H as a different combination of the first pair. The second pair is composed of one scanning line 32 in the even-numbered row (a (2k)-th row) and one scanning line 32 in the odd-numbered row (a (2k+1)-th row) adjacent to the foregoing scanning line 32 in the positive side of the y direction. In other words, the first and the second pairs are in the relationship in which one scanning line 32 of one pair straddles the other pair in the y direction.

The scanning line driving circuit 42 simultaneously selects two scanning lines 32 of the second pair by setting a scanning signal Y[2k] and a scanning signal Y[2k+1] in one selection period H in the unit period U2 to have a selected potential. For example, in a first selection period H in the unit period U2, two scanning lines 32 in the second and the third rows are simultaneously selected, and in a second selection period H in the unit period U2, two scanning lines 32 in the fourth and the fifth rows are simultaneously selected. For the sake of convenience in description of the first embodiment, a case in which the first and M-th scanning lines 32 are not selected in the unit period U2 has been exemplified, but it is also possible to select the first and M-th scanning lines 32 in the unit period U2.

Note that, hereinbelow, there is a case in which each scanning line 32 in an odd-numbered row is referred to as a first scanning line and each scanning line 32 in an even-numbered row is referred to as a second scanning line. In addition, there is a case in which, out of two pixels PIX adjacent to each other in the y direction, a pixel PIX in an odd-numbered row is referred to as a first pixel, and a pixel PIX in an even-numbered row is referred to as a second pixel.

The signal line driving circuit 44 sequentially supplies grayscale potentials X[1] to X[N] according to image signals of the right-eye image GR to each signal line 34 for each selection period H in the right-eye display period PR, and sequentially supplies the grayscale potentials X[1] to X[N] according to image signals of the left-eye image GL to each signal line 34 for each selection period H in the left-eye display period PL.

In other words, the display control circuit 142 and the signal line driving circuit 44 generate a grayscale potential X[n] based on the display data V supplied from an external circuit, and function as second driving circuits which supply the grayscale potential X[n] to each signal line 34.

FIG. 3 shows a temporal change of the polarity (writing polarity) of each grayscale potential X[n] with respect to a predetermined reference potential (for example, the potential of the common electrode 64). Since the grayscale potential X[n] is supplied to the pixel electrode 62 of the liquid crystal element CL, the polarity exemplified in FIG. 3 can be deemed to be the same as that of a voltage applied to the liquid crystal element CL.

As shown in FIG. 3, the signal line driving circuit 44 reverses the polarity of the grayscale potential X[n] for each unit period U (U1 or U2) in each control period T, and sets the grayscale potential X[n] to have the reversed polarity in each unit period U in each control period T positioned before and after. Specifically, in the control period T1, the polarity of the grayscale potential X[n] is set to be the positive polarity (+) in the unit period U1 of each display period P (PR or PL) and to be the negative polarity (−) in the unit period U2 of each display period P. On the contrary, in the control period T2 positioned immediately after the control period T1, the polarity of the grayscale potential X[n] is set to be the negative polarity (−) in the unit period U1 of each display period P (PR or PL) and to be the positive polarity (+) in the unit period U2 of each display period P.

The relationship between the display data V (right-eye display data VR and left-eye display data VL), the image signal G (the right-eye image GR and the left-eye image GL), and the grayscale potential X[n] will be described below.

Hereinbelow, a grayscale designated by right-eye display data VR in the display data V for a pixel PIX in the m-th row and the n-th column is indicated by a grayscale VR[m][n], a grayscale designated by left-eye display data VL in the display data V for a pixel PIX in the m-th row and the n-th column is indicated by a grayscale VL[m][n], a grayscale designated by an image signal G of the right-eye image GR for a pixel PIX in the m-th row and the n-th column is indicated by a grayscale GR[m][n], and a grayscale designated by an image signal G of the left-eye image GL for a pixel PIX in the m-th row and the n-th column is indicated by a grayscale GL[m][n].

In the unit period U1 of the right-eye display period PR in each control period T (T1 and T2), in the selection period H in which two scanning lines 32 in the (2k−1)-th row and the (2k)-th row composing the first pair are selected, a grayscale GR[2k−1][n] designated by the right-eye image GR for a pixel PIX in the (2k−1)-th row and the n-th column is computed as a weighted average of a grayscale VR[2k−1][n] (first grayscale) designated by the right-eye display data VR for the pixel PIX (first pixel) in the (2k−1)-th row and the n-th column and a grayscale VR[2k][n] (second grayscale) designated by the right-eye display data VR for the pixel PIX (second pixel) in the (2k)-th row and the n-th column. Then, in the selection period H, the signal line driving circuit 44 supplies grayscale potentials X[1] to X[n] according to the grayscales GR[2k−1][1] to GR[2k−1][N] to each of N signal lines 34. Therefore, as shown in the portion (R1) of FIG. 3, a grayscale potential X[n] according to the grayscale GR[2k−1][n] designated by the image signal G of the right-eye image GR for the pixel PIX in the (2k−1)-th row and the n-th column is supplied commonly to two pixels PIX in the n-th column out of the pixels PIX in the (2k−1)-th row and the (2k)-th row composing the first pair.

More specifically, the grayscale GR[2k−1][n] is determined based on the following formula (1).

$$GR[2k-1][n]=\{(w_{2k-1}\times VR[2k-1][n])+(w_{2k}\times VR[2k][n])\}/\{w_{2k-1}+w_{2k}\} \quad \text{Formula (1)}$$

Herein, the weighting coefficient $w_{2k-1}$ (a first weighting coefficient) and $w_{2k}$ (a second weighting coefficient) appearing in Formula (1) may be any values if they are real numbers greater than "0". In the present embodiment, the weighting coefficient $w_{2k-1}$ and $w_{2k}$ are set to be the same value which is, for example, "1". In other words, in this embodiment, the grayscale GR[2k−1][n] is computed as a simple average (arithmetic average) of the grayscale VR[2k−1] and the grayscale VR[2k].

Note that, when the arithmetic result of the right side of Formula (1) is not an integer, the grayscale GR[2k−1][n] may be computed by further executing an arithmetic operation such as rounding up or rounding down numbers after the decimal point for the arithmetic result of the right side of Formula (1).

For example, in the first selection period H in the unit period U1, a grayscale potential X[n] according to the grayscale GR[1][n] computed as the average of the grayscale VR[1][n] designated by the right-eye display data VR for a pixel PIX in the first row and the n-th column and the grayscale VR[2][n] designated by the right-eye display data VR for a pixel PIX in the second row and the n-th column is supplied commonly to the two pixels PIX in the first row and the n-th column and the second row and the n-th column. In addition, in the second selection period H in the unit period U1, a grayscale potential X[n] according to the grayscale GR[3][n] computed as the average of the grayscale VR[3][n] designated by the right-eye display data VR for a pixel PIX in the third row and the n-th column and the grayscale VR[4][n] designated by the right-eye display data VR for a pixel PIX in the fourth row and the n-th column is supplied commonly to the two pixels PIX in the third row and the n-th column and the fourth row and the n-th column.

As above, in the unit period U1, since the common grayscale potential X[n] is supplied to the two pixels PIX adjacent to each other in the y direction, at the time when the unit period U1 of the right-eye display period PR ends, the right-eye image GR of which resolution in the y direction is lowered to half is displayed in the pixel unit 30.

In the unit period U2 of the right-eye display period PR in each control period T (T1 and T2), in the selection period H in which two scanning lines 32 in the (2k)-th row and the (2k+1)-th row composing the second pair are selected, a grayscale GR[2k][n] designated by the right-eye image GR for a pixel PIX in the (2k)-th row and the n-th column is computed as a weighted average of a grayscale VR[2k+1][n] (first grayscale) designated by the right-eye display data VR for the pixel PIX (first pixel) in the (2k+1)-th row and the n-th column and the grayscale VR[2k][n] (second grayscale) designated by the right-eye display data VR for the pixel PIX (second pixel) in the (2k)-th row and the n-th column. Then, in the selection period H, the signal line driving circuit 44 supplies the grayscale potentials X[1] to X[n] according to the grayscales GR[2k][1] to GR[2k][N] to each of N signal lines 34. Therefore, as shown in the portion (R2) of FIG. 3, a grayscale potential X[n] according to the grayscale GR[2k][n] designated by the image signal G of the right-eye image GR for the pixel PIX in the (2k)-th row and the n-th column is supplied commonly to two pixels PIX in the n-th column out of the pixels PIX in the (2k)-th row and the (2k+1)-th row composing the second pair. More specifically, the grayscale GR[2k][n] is determined based on the following formula (2).

$$GR[2k][n]=\{(w_{2k}\times VR[2k][n])+(w_{2k+1}\times VR[2k+1][n])\}/\{w_{2k}+w_{2k+1}\} \quad \text{Formula (2)}$$

Herein, the weighting coefficient $w_{2k+1}$ (a first weighting coefficient) and $w_{2k}$ (a second weighting coefficient) appearing in Formula (2) may be any values if they are real numbers greater than "0". In the present embodiment, the weighting coefficient $w_{2k}$ and $w_{2k+1}$ are set to be the same value which is, for example, "1".

For example, in the first selection period H in the unit period U2, the grayscale potential X[n] according to the grayscale GR[2][n] computed as the average of the grayscale VR[2][n] designated by the right-eye display data VR for a pixel PIX in the second row and the n-th column and the grayscale VR[3][n] designated by the right-eye display data VR for a pixel PIX in the third row and the n-th column is supplied commonly to the two pixels PIX in the second row and the n-th column and the third row and the n-th column. In addition, in the second selection period H in the unit period U2, the grayscale potential X[n] according to the grayscale GR[4][n] computed as the average of the grayscale VR[4][n] designated by the right-eye display data VR for the pixel PIX in the fourth row and the n-th column and the grayscale VR[5][n] designated by the right-eye display data VR for a pixel PIX in the fifth row and the n-th column is supplied commonly to the two pixels PIX in the fourth row and the n-th column and the fifth row and the n-th column.

As above, in the unit period U2, since the common grayscale potential X[n] is supplied to the two pixels PIX adjacent to each other in the y direction, at the time when the unit period U2 of the right-eye display period PR ends, the right-eye image GR of which resolution in the y direction is lowered to half is displayed in the pixel unit 30.

Note that, in a configuration in which the first row and the M-th row are selected in the unit period U2, the grayscale potential X[n] of a predetermined potential (for example, a potential corresponding to a halftone) is supplied to each signal line 34 in the selection period H in which, for example, the first row and the M-th row are selected.

The same operation as that in the right-eye display period PR is executed in the left-eye display period PL of each control period T (T1 and T2).

In other words, as shown in the portion (L1) of FIG. 3, in the unit period U1 of the left-eye display period PL in each control period T (T1 and T2), in the selection period H in which two scanning lines 32 in the (2k−1)-th row and the (2k)-th row composing the first pair are selected, a grayscale GL[2k−1][n] designated by the left-eye image GL for a pixel PIX in the (2k−1)-th row and the n-th column is computed as a weighted average of a grayscale VL[2k−1][n] (first grayscale) designated by the left-eye display data VL for the pixel PIX (first pixel) in the (2k−1)-th row and the n-th column and a grayscale VL[2k][n] (second grayscale) designated by the left-eye display data VL for the pixel PIX (second pixel) in the (2k)-th row and the n-th column. Then, in the selection period H, the signal line driving circuit 44 supplies grayscale potentials X[1] to X[N] according to the grayscales GL[2k−1][1] to GL[2k−1][N] to each of N signal lines 34. Therefore, a grayscale potential X[n] according to the grayscale GL[2k−1][n] designated by the image signal G of the left-eye image GL for the pixel PIX in the (2k−1)-th row and the n-th column is supplied commonly to two pixels PIX in the n-th column out of the pixels PIX in the (2k−1)-th row and the (2k)-th row composing the first pair. More specifically, the grayscale GL[2k−1][n] is determined based on the following formula (3).

$$GL[2k-1][n]=\{(w_{2k-1}\times VL[2k-1][n])+(w_{2k}\times VL[2k][n])\}/\{w_{2k-1}+w_{2k}\} \quad \text{Formula (3)}$$

Herein, the weighting coefficient $w_{2k-1}$ (a first weighting coefficient) and $w_{2k}$ (a second weighting coefficient) appearing in Formula (3) may be any values if they are real numbers greater than "0". In the present embodiment, the weighting coefficient $w_{2k-1}$ and $w_{2k}$ are set to be the same value which is, for example, "1".

In addition, as shown in the portion (L2) of FIG. 3, in the unit period U2 of the left-eye display period PL in each control period T (T1 and T2), in the selection period H in which two scanning lines 32 in the (2k)-th row and the (2k+1)-th row composing the second pair are selected, a grayscale GL[2k][n] designated by the left-eye image GL for a pixel PIX in the (2k)-th row and the n-th column is computed as a weighted average of a grayscale VL[2k+1][n] (first grayscale) designated by the left-eye display data VL for the pixel PIX (first pixel) in the (2k+1)-th row and the n-th column and a grayscale VL[2k][n] (second grayscale) designated by the left-eye display data VL for the pixel PIX (second pixel) in the (2k)-th row and the n-th column. Then, in the selection period H, the signal line driving circuit 44 supplies the grayscale potentials X[1] to X[N] according to the grayscales GL[2k][1] to GL[2k][N] to each of N signal lines 34. Therefore, a grayscale potential X[n] according to the grayscale GL[2k][n] designated by the image signal G of the left-eye image GL for the pixel PIX in the (2k)-th row and the n-th column is supplied commonly to two pixels PIX in the n-th column out of the pixels PIX in the (2k)-th row and the (2k+1)-th row composing the second pair. More specifically, the grayscale GL[2k][n] is determined based on the following formula (4).

$$GL[2k][n]=\{(w_{2k}\times VL[2k][n])+(w_{2k+1}\times VL[2k+1][n])\}/\{w_{2k}+w_{2k+1}\} \quad \text{Formula (4)}$$

Herein, the weighting coefficient $w_{2k+1}$ (a first weighting coefficient) and $w_{2k}$ (a second weighting coefficient) appearing in Formula (4) may be any values if they are real numbers greater than "0". In the present embodiment, the weighting coefficient $w_{2k}$ and $w_{2k+1}$ are set to be the same value which is, for example, "1".

In this manner, in the first embodiment, the grayscale potential X[n] is supplied commonly to the two pixels PIX which are positioned in two rows simultaneously selected in each unit period U (U1 and U2) and adjacent to each other in the y direction. Note that, hereinbelow, there is a case in which the two pixels PIX to which the grayscale potential X[n] is commonly supplied are referred to as "selected pixels". In addition, for each pixel PIX, there is a case in which a grayscale designated by the image signal G (the right-eye image GR and the left-eye image GL) in the unit period U1 of each display period P (the right-eye display period PR and the left-eye display period PL) is referred to as a first set grayscale, and a grayscale designated by the image signal G (the right-eye image GR and the left-eye image GL) in the unit period U2 is referred to as a second set grayscale.

As understood from the above description, in the unit period U1 of the right-eye display period PR, the left-eye image GL displayed in just previous left-eye display period PL is gradually updated to the right-eye image GR for each first pair (for each second row), and in the unit period U1 of the left-eye display period PL, the right-eye image GR displayed in just previous right-eye display period PR is gradually updated to the left-eye image GL for each first pair. In other words, in the unit period U1 of each display period P, the right-eye image GR and the left-eye image GL are mixed.

The glasses control circuit 144 of the control circuit 14 of FIG. 1 controls each state (open state or closed state) of the right-eye shutter 22 and the left-eye shutter 24 of the stereoscopic vision glasses 20 in synchronization with the operation of the electro-optical panel 12. Specifically, the glasses control circuit 144 controls both of the right-eye shutter 22 and the left-eye shutter 24 to be in a closed state in the unit period U1 of each display period P (PR and PL) as shown in FIG. 3. In addition, the glasses control circuit 144 controls the right-eye shutter 22 to be in an open state and the left-eye shutter 24 to be in a closed state in the unit period U2 of the right-eye display period PR, and controls the left-eye shutter 24 to be in an open state and the right-eye shutter 22 to be in a closed state in the unit period U2 of the left-eye display period PL.

Accordingly, the right-eye image GR displayed in the unit period U2 of the right-eye display period PR transmits through the right-eye shutter 22 and reaches to the right eye of an observer and at the same time is blocked by the left-eye shutter 24. On the other hand, the left-eye image GL displayed in the unit period U2 of the left-eye display period PL transmits through the left-eye shutter 24 and reaches to the left eye of the observer and at the same time is blocked by the right-eye shutter 22. By visually recognizing the right-eye image GR transmitting through the right-eye shutter 22 in the right eye and the left-eye image GL transmitting through the left-eye shutter 24 in the left eye, the observer perceives the stereoscopic effect of the display image.

As described above, the right-eye image GR and the left-eye image GL are mixed in the unit period U1 of each display period P, but as described referring to FIG. 3, since both of the right-eye shutter 22 and the left-eye shutter 24 are maintained to be in closed states in the unit period U1 of each display period P, the mixture of the right-eye image GR and the left-eye image GL (crosstalk) is not perceived by the observer. In other words, since the right-eye image GR and the left-eye image GL are reliably separated from the right and left eyes, the observer can realistically perceive the stereoscopic effect.

Note that, in each of the unit periods U1 and U2 of each display period P, an image obtained by reducing the resolution of an original display image expressed based on the display data V in the y direction (the right-eye image GR or the left-eye image GL) to half is displayed.

However, in the unit period U1 in the right-eye display period PR, the right-eye image GR displayed for each first pair according to the grayscale GR[2k−1] is gradually updated to an image displayed for each second pair according to the grayscale GR[2k] in the immediately following unit period U2. In other words, in the unit period U2 in the right-image display period PR, the right-eye image GR that has been displayed in the unit period U1 and the right-eye image GR to be displayed in the unit period U2 are mixed. The same is applied in the left-eye display period PL. Thus, there is an advantage that it is difficult for an observer to perceive a reduction in the resolution of a display image in each unit period U.

Herein, referring to FIGS. 5A to 5C and 6, a real image perceived by an observer when an image displayed in each first pair in the unit period U1 and an image displayed in each second pair in the unit period U2 are mixed will be described. Note that, for the sake of convenience of description, in FIGS. 5A to 5C and 6, among a plurality of pixels PIX arranged in a matrix form with M rows in the vertical direction and N columns in the horizontal direction, 64 pixels PIX in 8 rows in the vertical direction of the first to the eighth rows and 8 columns in the horizontal direction of the first to the eighth columns are exemplified.

Figure 5A:
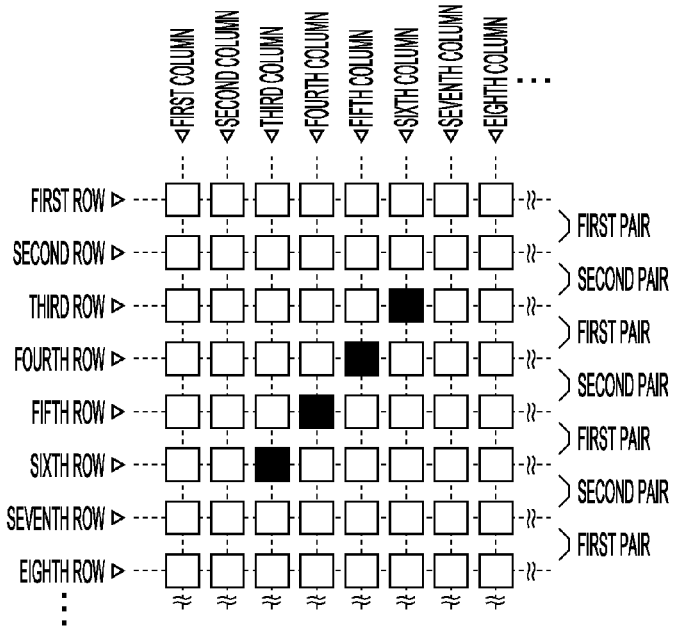
FIGS. 5A to 5C are illustrative diagrams indicating display data and grayscales displayed by a stereoscopic display device.
Figure 5B:
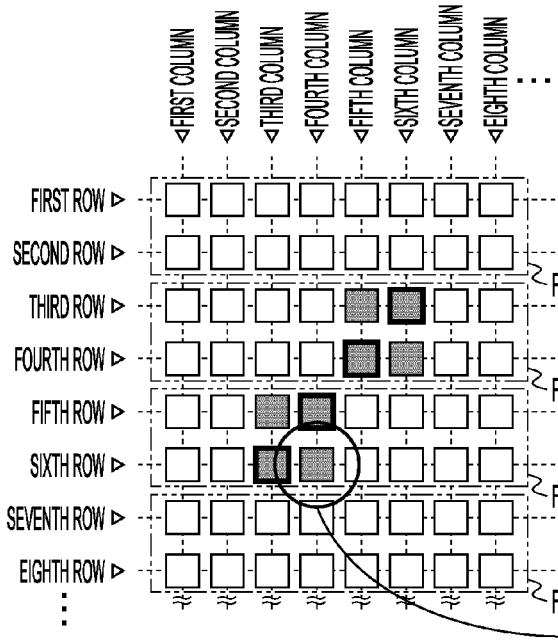
Figure 5C:
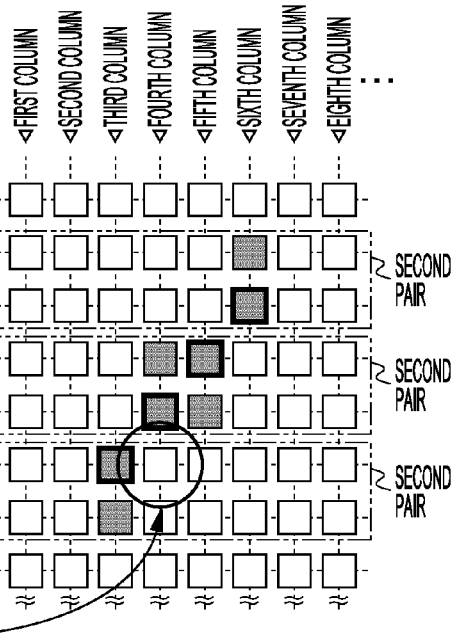

FIGS. 5A to 5C are illustrative diagrams expressing the relationship between the display data V supplied from an external circuit and the image signal G generated by the display control circuit 142. Note that, hereinbelow, a case in which the right-eye display data VR is supplied to the display control circuit 142 and the display control circuit 142 outputs the image signal G of the right-eye image GR will be described as an example, but the description below will be applied also to a case in which the left-eye display data VL is supplied to the display control circuit 142 and the display control circuit 142 outputs the image signal G of the left-eye image GL in the same manner.

FIG. 5A is an illustrative diagram in which the level of a grayscale VR[m][n] designated by the display data V (right-eye display data VR) supplied from the external circuit for each pixel PIX is expressed using gradation. In this example, when the grayscale designated by the display data V is the maximum, the corresponding pixel PIX is expressed in white, and when it is the minimum, the corresponding pixel PIX is expressed in black, and when it is an intermediate grayscale between the maximum and the minimum, the corresponding pixel PIX is expressed in an intermediate color between white and black (for example, gray).

In this example, among the pixels PIX positioned in the fourth column, for example, the right-eye display data VR sets the grayscale VR[5][4] by which the pixel PIX is designated in the fifth row to be the minimum grayscale (indicated in black in the drawing), and sets grayscales VR[1][4] to VR[4][4] and VR[6][4] to VR[8][4] designated for seven pixels PIX positioned elsewhere the fifth row to be the maximum grayscale (indicated in white in the drawing).

FIG. 5B is an illustrative diagram showing the level of the grayscale (first set grayscale) designated by the image signal G of the right-eye image GR for each pixel PIX in the unit period U1, and FIG. 5C is an illustrative diagram showing the level of the grayscale (second set grayscale) designated by the image signal G of the right-eye image GR for each pixel PIX in the unit period U2 when the right-eye display data VR shown in FIG. 5A is supplied from the external circuit. Note that, also in FIGS. 5B and 5C, the level of a grayscale designated by the image signal G for each pixel PIX is expressed using gradation in the same manner as in FIG. 5A.

Herein, the plurality of pixels PIX positioned, for example, in the fourth column will be discussed.

As shown in FIG. 5B, in the unit period U1, a grayscale potential X[n] according to the grayscale GR[3][4] computed as the average of the grayscales VR[3][4] and VR[4][4] is supplied to two pixels PIX (selected pixels) in the third and the fourth rows out of the pixels PIX positioned in the fourth column. As described above, since the grayscales VR[3][4] and VR[4][4] are the maximum grayscales, the grayscale GR[3][4] is also the maximum grayscale (in white in the drawing). In addition, a grayscale potential X[n] according to the grayscale GR[5][4] computed as the average of the grayscales VR[5][4] and VR[6][4] is supplied to two pixels PIX (selected pixels) in the fifth and the sixth rows out of the pixels PIX positioned in the fourth column. As described above, since the grayscale VR[5][4] is the minimum grayscale and the grayscale VR[4][4] is the maximum grayscale, the grayscale GR[5][4] is the intermediate grayscale (in gray in the drawing).

As shown in FIG. 5C, in the unit period U2, a grayscale potential X[n] according to the grayscale GR[4][4] computed as the average of the grayscales VR[4][4] and VR[5][4] is supplied to two pixels PIX (selected pixels) in the fourth and the fifth rows out of the pixels PIX positioned in the fourth column. As described above, since the grayscale VR[4][4] are the maximum grayscales, and the grayscale VR[5][4] is the minimum grayscale, the grayscale GR[4][4] is an intermediate grayscale (in gray in the drawing). In addition, a grayscale potential X[n] according to the grayscale GR[6][4] computed as the average of the grayscales VR[6][4] and VR[7][4] is supplied to two pixels PIX (selected pixels) in the sixth and the seventh rows out of the pixels PIX positioned in the fourth column. As described above, since the grayscales VR[6][4] and VR[7][4] are the maximum grayscales, the grayscale GR[6][4] is also the maximum grayscale (in white in the drawing).

In the unit period U2, the observer perceives an image in which the right-eye image GR displayed in the unit period U1 and the right-eye image GR displayed in the unit period U2 are mixed.

Figure 6:
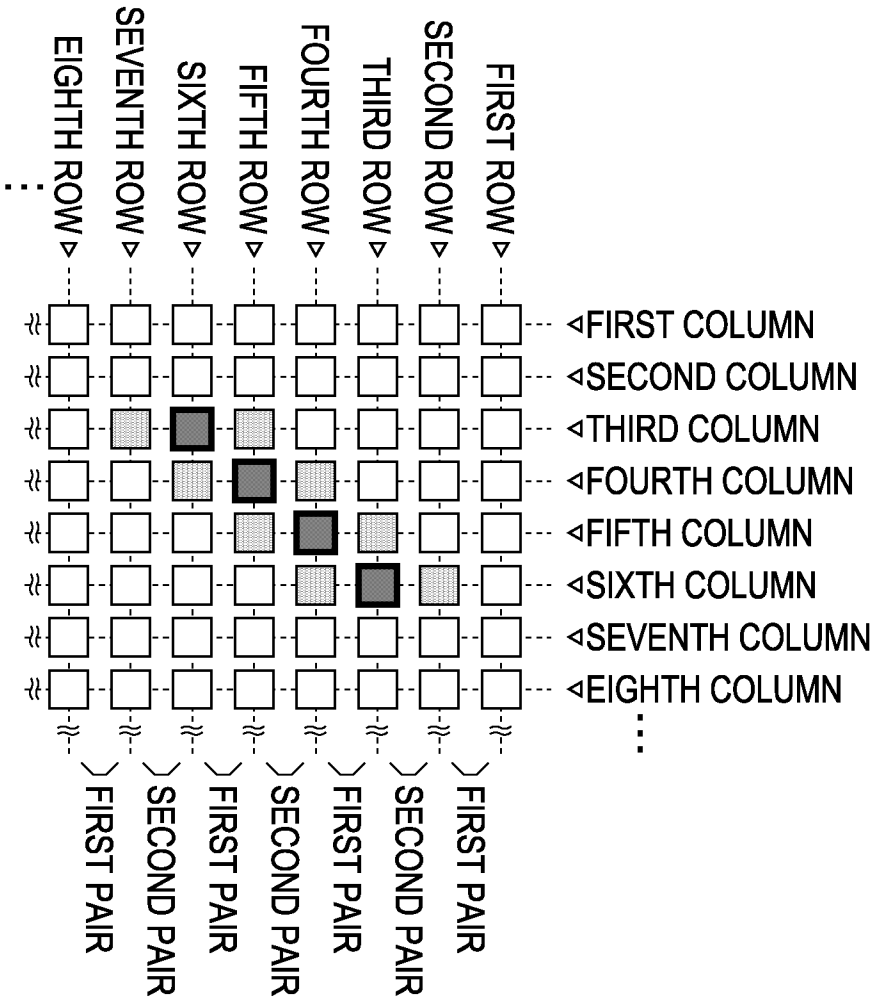
FIG. 6 is an illustrative diagram indicating grayscales that an observer perceives.

FIG. 6 is an illustrative diagram showing grayscales that the observer really perceives in the unit period U2 when the display data V shown in FIG. 5A is supplied from the external circuit.

To the pixel PIX positioned in the fifth row and the fourth column, for example, as shown in FIG. 5B, the grayscale potential X[n] according to the grayscale GR[5][4] (first set grayscale) which is an intermediate grayscale (gray in the drawing) in the unit period U1 is supplied, and as shown in FIG. 5C, the grayscale potential X[n] according to the grayscale GR[4][4] (second set grayscale) which is an intermediate grayscale (gray in the drawing) in the unit period U2 is supplied. Thus, as shown in FIG. 6, the pixel PIX positioned in the fifth row and the fourth column is perceived by the observer as a pixel expressed in the intermediate grayscale (gray in the drawing) which is a grayscale between the first set grayscale and the second set grayscale.

In addition, the pixel PIX positioned in the fourth row and the fourth column is perceived by the observer as a pixel expressed in a grayscale between the grayscale GR[3][4] (the first set grayscale) that is the maximum grayscale (white in the drawing) and the grayscale GR[4][4] that is the intermediate grayscale (gray in the drawing). The pixel PIX positioned in the sixth row and the fourth column is perceived by the observer as a pixel expressed in a grayscale between the grayscale GR[5][4] (the first set grayscale) that is the intermediate grayscale (gray in the drawing) and the grayscale GR[6][4] that is the maximum grayscale (white in the drawing).

Among eight pixels PIX positioned in the fourth column, five pixels PIX positioned in the rows other than the fourth to the sixth rows are perceived by the observer as pixels expressed in the maximum grayscale (white in the drawing).

Strictly speaking, the grayscale of a pixel PIX perceived by an observer is decided based on the position of the corresponding pixel PIX in the pixel unit 30, in addition to the first and the second set grayscales designated in the corresponding pixel PIX.

Specifically, the length of time of the period in which the period in which a pixel PIX positioned in the m-th row displays the first set grayscale designated in the unit period U1 overlaps the unit period U2 (in other words, in the unit period U2, a period in which the corresponding pixel PIX displays the first set grayscale) is set as a length of time s1[*m*], and the length of time of the period in which the period in which the corresponding pixel PIX displays the second set grayscale designated in the unit period U2 overlaps the unit period U2 (in other words, in the unit period U2, a period in which the corresponding pixel PIX displays the second set grayscale) is set as a length of time s2[*m*]. At this moment, the corresponding pixel PIX is perceived by the observer as a pixel displaying the grayscale corresponding to the weighted average of the first and the second set grayscales having the lengths of time s1 and s2 as weights.

The length of time s1[*m*] is shortened when a pixel PIX is positioned in the upper portion (on the negative side of the y direction) of the pixel unit 30. In this case, the pixel PIX is perceived by the observer as a pixel displaying a grayscale closer to the first set grayscale than to the second set grayscale.

Effect of First Embodiment

In the first embodiment described above, the grayscale potential X[n] is supplied to each pixel PIX by selecting two scanning lines 32 as one unit in each unit period U. Thus, in comparison to a configuration in which the grayscale potential X[n] is supplied to each pixel PIX by sequentially selecting the scanning lines 32 in a unit of one row in each selection period H for each display period P, the length of time of the period in which the right-eye image GR and the left-eye image GL are mixed (in other words, the period in which both of the right-eye shutter 22 and the left-eye shutter 24 are maintained to be in closed states) is shortened. In other words, in the display period P, a length of time in which the right-eye shutter 22 or the left-eye shutter 24 can be maintained to be in an open state is sufficiently secured. Accordingly, the brightness of a display image that an observer recognizes can improve.

In addition, in the first embodiment, the grayscale potential X[n] is supplied to each pixel PIX by selecting two scanning lines 32 as one unit in each of the unit periods U1 and U2 of each display period P. Therefore, there is another advantage that the transfer speed of the display data V and the image signal G and the operation speed of the driving circuit 40 can be maintained equally to a configuration in which a display image is updated in the cycle of the display period P.

In addition, in the first embodiment, the grayscale potential X[n] according to a grayscale GR[2k−1][n] designated by the right-eye image GR is set to have the positive polarity in the unit period U1 of the right-eye display period PR in the control period T1, and set to have the negative polarity in the unit period U1 of the right-eye display period PR in the control period T2. The length of time in which the grayscale potential X[n] is set to have the positive polarity and the length of time in which the grayscale potential X[n] is set to have the negative polarity are uniformed in the same manner as for a grayscale GR[2k][n] in the unit period U2 of the right-eye display period PR, a grayscale GL[2k−1][n] in the unit period U1 of the left-eye display period PL, and a grayscale GL[2k][n] in the unit period U2 of the left-eye display period PL. Therefore, there is another advantage of suppressing application of direct current components to the liquid crystal element CL (suppressing deterioration of the liquid crystal element CL).

In addition, in the first embodiment, as described above, an image displayed in the unit period U1 and an image displayed in the unit period U2 are mixed in the unit period U2 in the right-eye display period PR. This is the same as in the left-eye display period PL. Therefore, there is another advantage in that it is difficult for an observer to perceive degradation of the resolution of a display image in each unit period U.

As an electronic apparatus which displays a stereoscopic image which causes an observer to perceive the stereoscopic effect based on the display data V (the right-eye display data VR and the left-eye display data VL), it is also possible to assume a configuration in which images indicated by the right-eye display data VR and images indicated by the left-eye display data VL are alternately displayed in a time division manner in such a way that two scanning lines 32 are selected as one unit, and a grayscale designated by the display data V for one pixel PIX out of two pixels PIX in two rows that are simultaneously selected and adjacent to each other in the y direction is supplied commonly to the two pixels PIX (hereinafter, referred to as "Comparison Example 1").

According to the Comparison Example 1, there are advantages in the effects as described above, in other words, firstly, the brightness of a display image that an observer recognizes can improve by sufficiently securing the length of time in which the right-eye shutter 22 or the left-eye shutter 24 can be maintained to be an open state for the display period P, secondly, the transfer speed of the display data V and the operation speed of the driving circuit 40 can be maintained equally to the configuration in which a display image is updated in the cycle of the display period P, thirdly, the application of direct current components to the liquid crystal element CL can be suppressed, and fourthly, the deterioration of resolution is difficult to be perceived by the observer.

Since the image signal G is generated based on the display data V, the first embodiment has an effect of suppressing the occurrence of "flickering" caused by changes in the grayscale displayed by each pixel PIX. On the other hand, in Comparison Example 1, it is not possible to obtain the effect of suppressing the occurrence of "flickering" as above. Hereinbelow, in order to describe the effect of suppressing the occurrence of "flickering" of the first embodiment in detail, the problem of the occurrence of "flickering" in Comparison Example 1 will be described. In Comparison Example 1 shown below, for the elements that have the same actions and functions as those in the first embodiment, the same reference numerals of the above description will be used, and detailed description thereof will be appropriately omitted.

Figure 7:
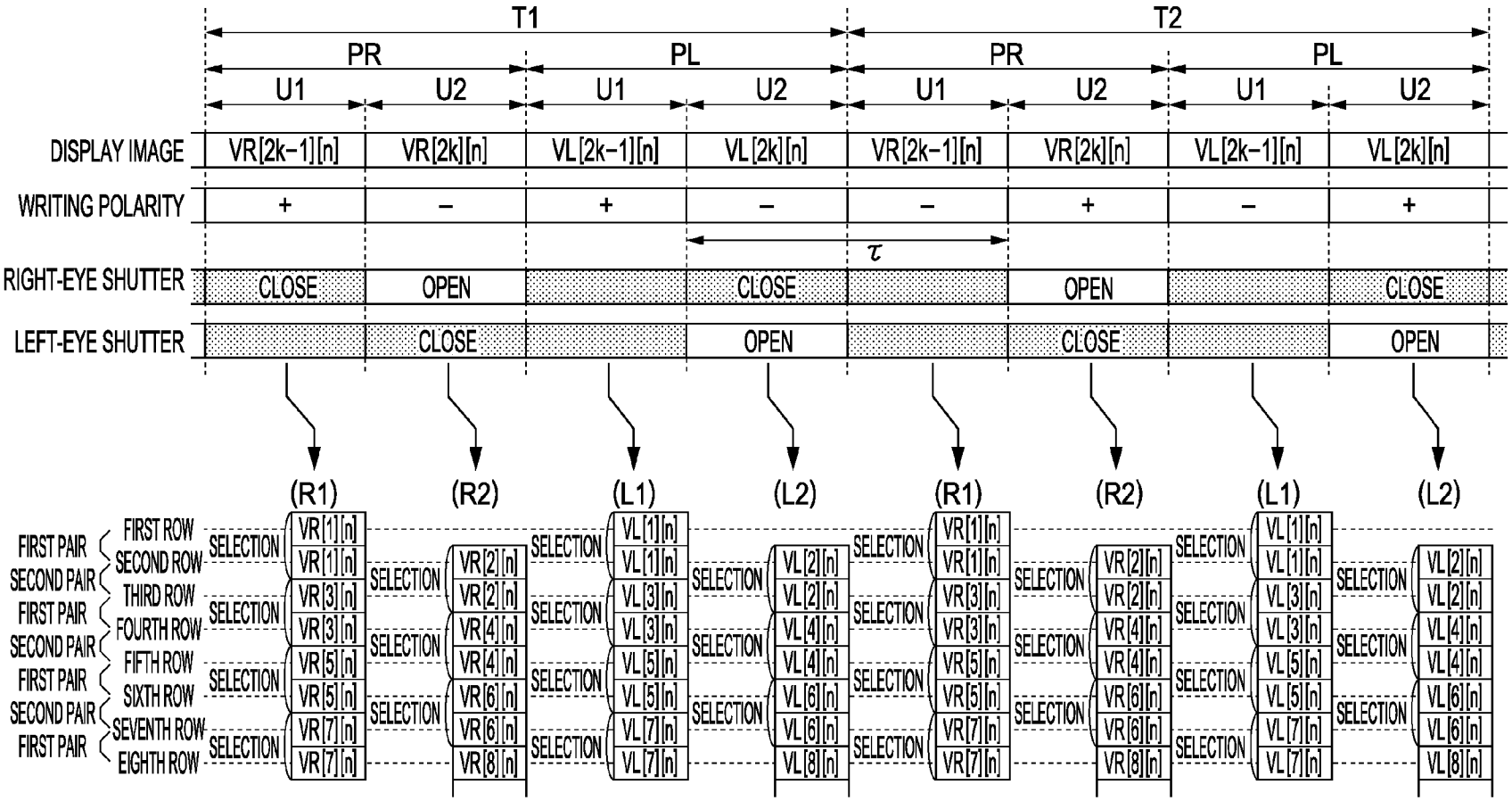
FIG. 7 is an illustrative diagram of an operation of Comparison Example 1.

Referring to FIG. 7, a display operation of an electro-optical device according to Comparison Example 1 will be described.

As shown in FIG. 7, in the unit period U1 of the right-eye display period PR within each control period T(T1 and T2), in the selection period H in which two scanning lines 32 in the (2k−1)-th row and the (2k)-th row composing the first pair are selected, the signal line driving circuit 44 supplies grayscale potentials X[1] to X[N] according to grayscales VR[2k−1][1] to VR[2k−1][N] designated by the right-eye display data VR for each pixel PIX in the (2k−1)-th row to each of N signal line 34. Thus, as shown in the portion (R1) of FIG. 7, the grayscale potential X[n] according to the grayscale VR[2k−1][N] designated by the right-eye display data VR for the pixel PIX in the (2k−1)-th row and the n-th column is supplied to two pixels PIX (selected pixels) in the n-th column among the pixels PIX in the (2k−1)-th row and the (2k)-th row composing the first pair.

In addition, in the unit period U2 of the right-eye display period PR within each control period T(T1 and T2), in the selection period H in which two scanning lines 32 in the (2k)-th row and the (2k+1)-th row composing the second pair are selected, the signal line driving circuit 44 supplies the grayscale potentials X[1] to X[N] according to grayscales VR[2k][1] to VR[2k][N] designated by the right-eye display data VR for each pixel PIX in the (2k)-th row to each of N signal line 34. Thus, as shown in the portion (R2) of FIG. 7, the grayscale potential X[n] according to the grayscale VR[2k][N] designated by the right-eye display data VR for the pixel PIX in the (2k)-th row and the n-th column is supplied to the two pixels PIX (selected pixels) in the n-th column among the pixels PIX in the (2k)-th row and the (2k+1)-th row composing the second pair.

The same operation as in the right-eye display period PR is executed in the left-eye display period PL of each control period T (T1 and T2). In other words, as shown in the portion (L1) of FIG. 7, in each selection period H within the unit period U1 of the left-eye display period PL, the grayscale potential X[n] according to the grayscale VL[2k−1][N] designated by the left-eye display data VL for the pixel PIX in the (2k−1)-th row and the n-th column is supplied to two pixels PIX (selected pixels) in the n-th column among the pixels PIX in the (2k−1)-th row and the (2k)-th row composing the first pair. In addition, as shown in the portion (L2) of FIG. 7, in each selection period H within the unit period U2 of the left-eye display period PL, the grayscale potential X[n] according to the grayscale VL[2k][N] designated by the left-eye display data VL for the pixel PIX in the (2k)-th row and the n-th column is supplied to the two pixels PIX (selected pixels) in the n-th column among the pixels PIX in the (2k)-th row and the (2k+1)-th row composing the second pair.

FIGS. 8A to 8C and 9 are illustrative drawings expressing the relationship between the grayscales designated by the display data V supplied to an electro-optical device according to Comparison Example 1 and an image perceived by an observer.

Figure 8A:
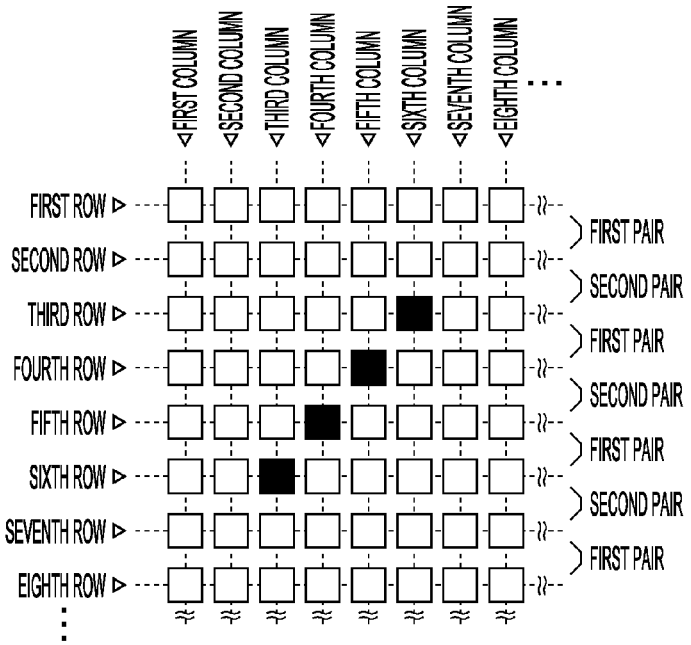
FIGS. 8A to 8C are illustrative diagrams indicating display data and grayscales to be displayed which are supplied to a stereoscopic display device according to Comparison Example 1.

FIG. 8A is an illustrative diagram expressing the level of a grayscale VR[m][n] designated by the display data V (right-eye display data VR) supplied from an external circuit for each pixel PIX using gradation. The display data V shown in FIG. 8A is the same as the display data V shown in FIG. 5A. Note that, herein, description is provided by exemplifying the right-eye display data VR as the display data V, but in the following description, the same configuration is applied in a case in which left-eye display data VL is exemplified as the display data V.

Figure 8B:
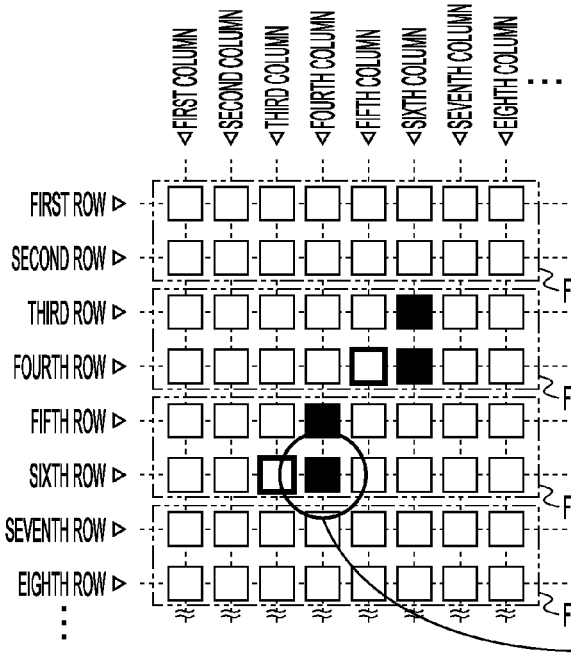
Figure 8C:
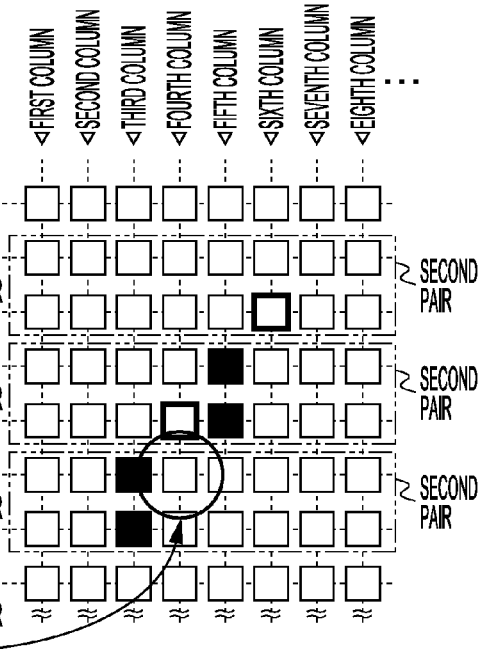

FIG. 8B shows the level of the grayscale VR[m][n] designated by the right-eye display data VR for each pixel PIX in the unit period U1, and FIG. 8C shows the level of the grayscale VR[m][n] designated by the right-eye display data VR for each pixel PIX for the unit period U2.

As shown in FIG. 8B, in the unit period U1, to two pixels PIX (selected pixels) positioned in the third and fourth rows among the pixels PIX positioned in the fourth column, a grayscale potential X[n] according to the grayscale VR[3][4] is supplied. Herein, the grayscale VR[3][4] is the maximum grayscale (white in the drawing). In addition, to two pixels PIX (selected pixels) positioned in the fifth and sixth rows among the pixels PIX positioned in the fourth column, a grayscale potential X[n] according to the grayscale VR[5][4] is supplied. Herein, the grayscale VR[5][4] is the minimum grayscale (black in the drawing).

As shown in FIG. 8C, in the unit period U2, to two pixels PIX (selected pixels) positioned in the fourth and fifth rows among the pixels PIX positioned in the fourth column, a grayscale potential X[n] according to the grayscale VR[4][4] is supplied. Herein, the grayscale VR[4][4] is the maximum grayscale (white in the drawing). In addition, two pixels PIX (selected pixels) positioned in the sixth and seventh rows among the pixels PIX positioned in the fourth column, a grayscale potential X[n] according to the grayscale VR[6][4] is supplied. Herein, the grayscale VR[6][4] is the maximum grayscale (white in the drawing).

Figure 9:
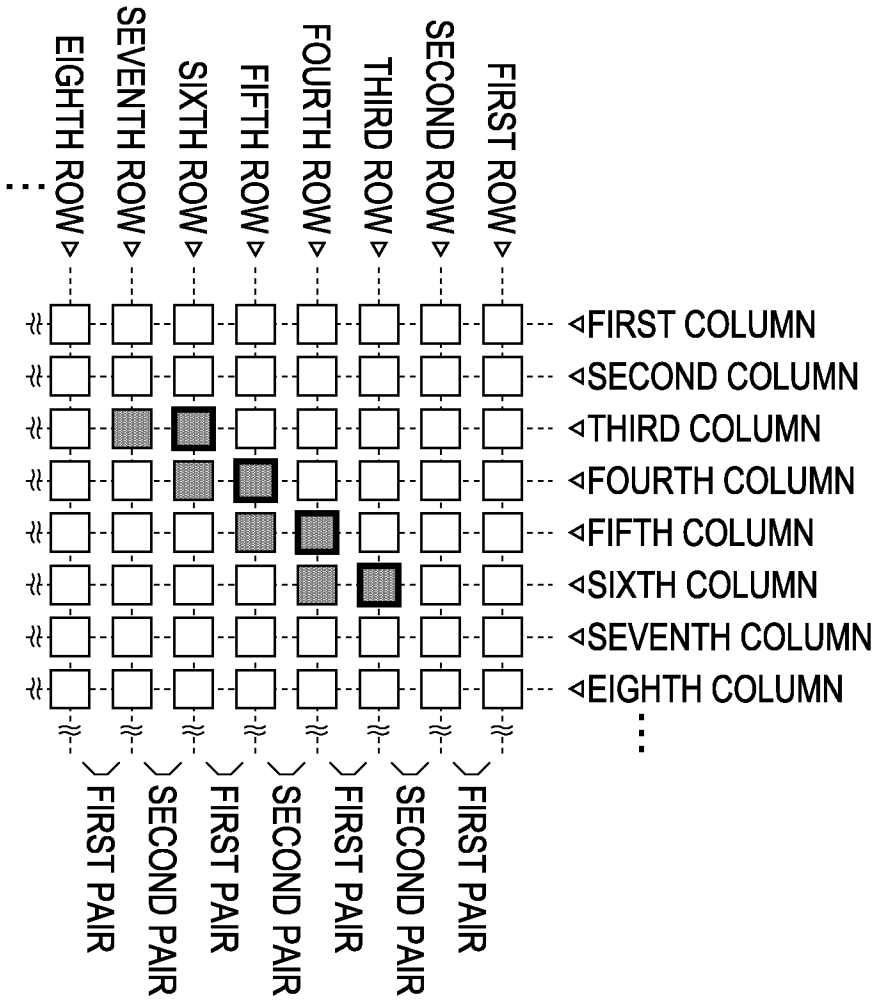
FIG. 9 is an illustrative diagram indicating grayscales that an observer perceives in Comparison Example 1.

In this case, in the unit period U2, the observer perceives an image in which an image displayed in the unit period U1 and an image displayed in the unit period U2 as shown in FIG. 9.

Herein, for example, to the pixels PIX in the fifth row and the fourth column to which the mark "O" is given in FIGS. 8B and 8C, the minimum grayscale (black) is designed in the unit period U1, and the maximum grayscale (white) is designated in the unit period U2. In other words, the pixel PIX in the in the fifth row and fourth column displays the minimum grayscale in a fixed period (in other words, a period corresponding to a length of time s1[5]) in the unit period U2, and displays the maximum grayscale in the period until the unit period U2 ends thereafter (in other words, a period corresponding to the length of time s2[5]). In this manner, the grayscale displayed in the pixel PIX in the fifth row and the fourth column is dramatically changed from the minimum scale to the maximum scale during the unit period U2. In this example, grayscales displayed in seven pixels PIX in the third row and sixth column, fourth row and sixth column, fourth row and fifth column, fifth row and fifth column, sixth row and fourth column, sixth row and third column, and seventh row and third column are dramatically changes during the unit period U2.

As above, when a grayscale displayed in a pixel PIX is changed in the unit period U2, the observer may perceive the change in the grayscale displayed in the pixel PIX as "flickering". Particularly, when there is a significant difference between a grayscale designated during the unit period U1 and a grayscale designated during the unit period U2 for a pixel PIX as in the example shown in FIGS. 8A to 8*c* and 9, the grayscale displayed in the corresponding pixel PIX is significantly changed during the unit period U2, and therefore, it is highly likely for the observer to perceive the change in the grayscale of the corresponding pixel PIX as "flickering". In addition, when the video expressing the display data V is a still image, such changes in the grayscale of each pixel PIX shown in FIGS. 8B and 8C are continuously repeated in each control period T, and therefore, it is highly likely for the observer to perceive the changes in the grayscale of each pixel PIX as "flickering".

On the other hand, in the first embodiment, the signal line driving circuit 44 causes a grayscale potential X[n] according to the grayscale computed as the average of a grayscale designated by the display data V for one pixel PIX and a grayscale designated by the display data V for the other pixel PIX to be supplied commonly to two pixels PIX (selected pixels) which are positioned in two rows and adjacent to each other in the y direction so simultaneously selected in each unit period U (U1 and U2). Accordingly, in the first embodiment, the amount of a change in the grayscale of each pixel PIX in the unit period U2 can be suppressed to about half of that in Comparison Example 1.

When the display data V shown in FIG. 5A is supplied from an external circuit, for example, whereas the grayscale of the pixel PIX in the fifth row and fourth column is dramatically changed from the minimum grayscale (black) to the maximum grayscale (white) as shown in FIGS. 8B and 8C in Comparison Example 1, in the first embodiment, the grayscale of the pixel PIX in the fifth row and fourth column undergoes merely a change from an intermediate grayscale (gray) to the maximum grayscale (white) as shown in FIGS. 5B and 5C.

In other words, in the first embodiment, it is possible to reduce the possibility of perceiving changes in the grayscale of each pixel PIX as "flickering" by the observer by suppressing the amount of a change from the grayscale by which each pixel PIX is designated in the unit period U1 (first set grayscale) and the grayscale by which each pixel PIX is designated in the unit period U2 (second set grayscale) to a low level.

Second Embodiment

When the polarity of a grayscale potential X[n] in each unit period U is reversed in each control period T as in the first embodiment, a voltage applied to the liquid crystal element CL maintains the same polarity over a length of time $\tau$ of the two unit periods U interposing the boundary of each control period T as shown in FIG. 3. As the period in which a voltage having the same polarity is applied to the liquid crystal element CL becomes longer, it is easy for an observer to perceive the fluctuation ("flickering") of displayed grayscales caused by the difference in polarities of the grayscale potential X[n]. Thus, in a configuration in which the polarity of the grayscale potential X[n] is maintained to be the same in a long cycle over two unit periods U as in the first embodiment, there is a problem in that flickering is easily perceived by an observer.

A second embodiment aims to solve the above problem that can occur in the first embodiment. Note that, in each example below, for the elements that have the same actions and functions as those in the first embodiment, the same reference numerals referred in the above description will be used, and detailed description thereof will be appropriately omitted.

Figure 10:
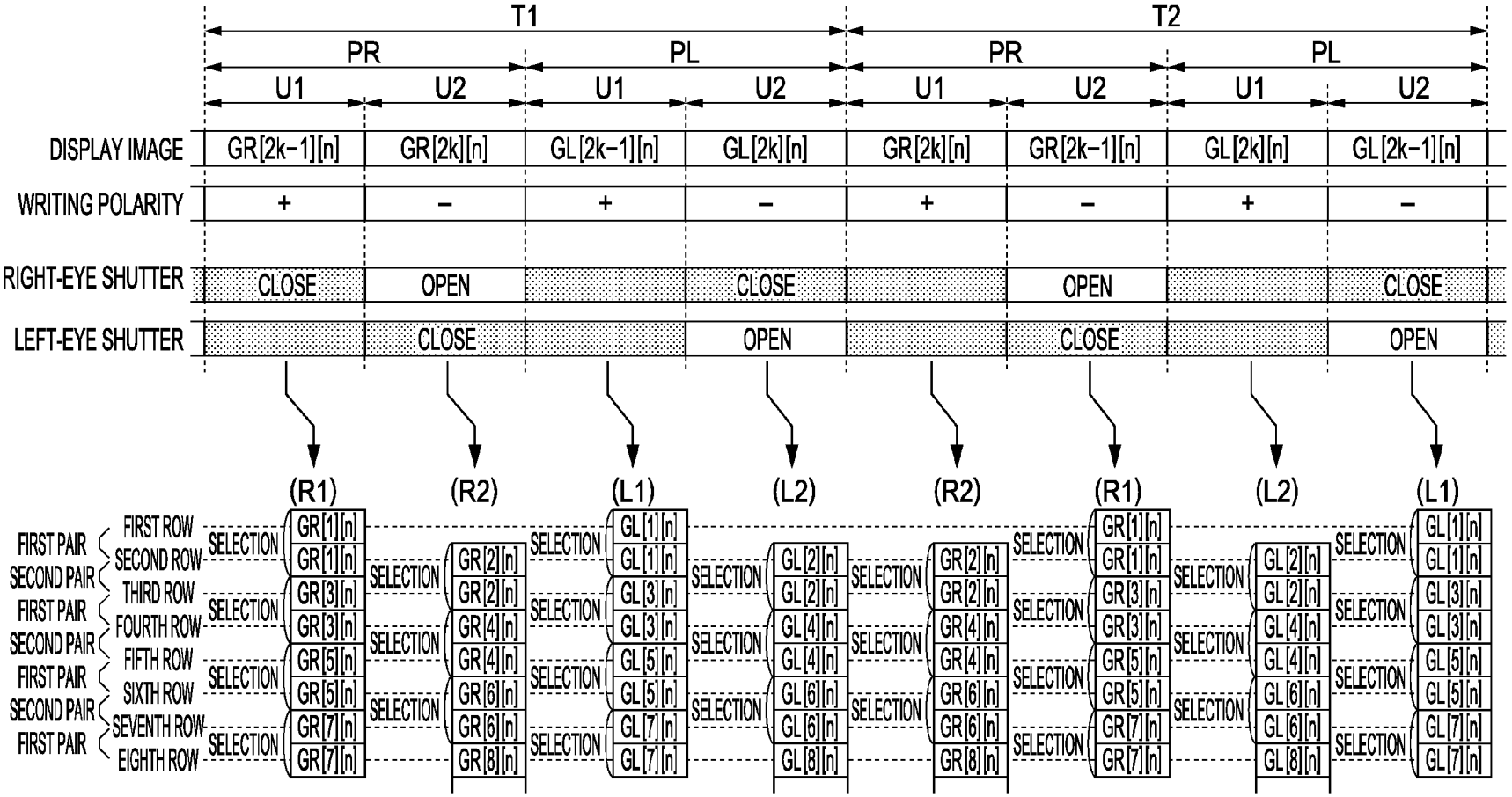
FIG. 10 is an illustrative diagram of an operation of a second embodiment of the invention.

FIG. 10 is an illustrative diagram of an operation of the electro-optical device 10 according to the second embodiment. In the second embodiment, in both of the control period T1 and the control period T2, the polarity of a grayscale potential X[n] is set to be the positive polarity (+) in the unit period U1 of and to be the negative polarity (−) in the unit period U2 of each display period P. Thus, the polarity of the grayscale potential X[n] is reversed in each unit period U (U1 and U2) at all times, and any unit period U in which the grayscale potential X[n] has the same polarity is not continuous on the time axis. Accordingly, with the electro-optical device 10 according to the second embodiment, it may be difficult for an observer to perceive flickering caused by a difference in polarities of the grayscale potential X[n].

In the second embodiment, the relationship between the unit period U1 or unit period U2 of each display period P and a selection target (first pair or second pair) by the scanning line driving circuit 42 in the control period T1 is reversed in the control period T2. In other words, as shown in FIG. 10, the scanning line driving circuit 42 sequentially selects first pairs for each selection period H in the unit period U1 of each display period P (PR and PL) and sequentially selects second pairs for each selection period H in the unit period U2 in the control period T1 in the same manner as in the first embodiment. On the other hand, in the control period T2, the scanning line driving circuit 42 sequentially selects the second pairs for each selection period H in the unit period U1 and sequentially selects the first pairs in the unit period U2 for each selection period H of each display period P (PR and PL) as shown in FIG. 10.

The operation of the signal line driving circuit 44 in the control period T1 is the same as in the first embodiment. In other words, as shown in FIG. 10, in a selection period H in which two scanning lines 32 in the (2k−1)-th row and the (2k)-th row constituting the first pair are selected in the unit period U1 of each display period P (PR and PL), the grayscales (GR[2k−1][n] and GL[2k−1][n]) designated by the image signal G for a pixel PIX in the (2k−1)-th row and the n-th column is computed as a weighted average of the grayscales (VR[2k−1][n] and VL[2k−1][n]) designated for the pixel PIX in the (2k−1)-th row and the n-th column and the grayscales (VR[2k][n] and VL[2k][n]) designated for the pixel PIX in the (2k)-th row and the n-th column by the display data V. Then, in the corresponding selection period H, the signal line driving circuit 44 supplies a grayscale potential X[n] according to the grayscales (GR[2k−1][n] and GL[2k−1][n]) to each signal line 34.

In addition, in a selection period H in which two scanning lines 32 in the (2k)-th row and the (2k+1)-th row constituting a second pair are selected in the unit period U2 of each display period P, the grayscales (GR[2k][n] and GL[2k][n]) designated by the image signal G for a pixel PIX in the (2k)-th row and the n-th column is computed as a weighted average of the grayscales (VR[2k][n] and VL[2k][n]) designated for the pixel PIX in the (2k)-th row and the n-th column and the grayscales (VR[2k+1][n] and VL[2k+1][n]) designated for the pixel PIX in the (2k+1)-th row and the n-th column by the display data V. Then, in the corresponding selection period H, the signal line driving circuit 44 supplies a grayscale potential X[n] according to the grayscales (GR[2k][n] and GL[2k][n]) to each signal line 34.

On the other hand, in each display period P (PR and PL) of the control period T2, in a selection period H in which two scanning lines 32 in the (2k)-th row and the (2k+1)-th row constituting a second pair are selected in the unit period U1 of each display period P (PR and PL), the grayscales (GR[2k][n] and GL[2k][n]) designated by the image signal G for a pixel PIX in the (2k)-th row and the n-th column is computed as a weighted average of the grayscales (VR[2k][n] and VL[2k][n]) designated for the pixel PIX in the (2k)-th row and the n-th column and the grayscales (VR[2k+1][n] and VL[2k+1][n]) designated for the pixel PIX in the (2k+1)-th row and the n-th column by the display data V. Then, in the corresponding selection period H, the signal line driving circuit 44 supplies a grayscale potential X[n] according to the grayscales (GR[2k][n] and GL[2k][n]) to each signal line 34.

In addition, in a selection period H in which two scanning lines 32 in the (2k−1)-th row and the (2k)-th row constituting a first pair are selected in the unit period U2 of each display period P, the grayscales (GR[2k−1][n] and GL[2k−1][n]) designated by the image signal G for a pixel PIX in the (2k−1)-th row and the n-th column is computed as a weighted average of the grayscales (VR[2k−1][n] and VL[2k−1][n]) designated for the pixel PIX in the (2k−1)-th row and the n-th column and the grayscales (VR[2k][n] and VL[2k][n]) designated for the pixel PIX in the (2k)-th row and the n-th column by the display data V. Then, in the corresponding selection period H, the signal line driving circuit 44 supplies a grayscale potential X[n] according to the grayscales (GR[2k−1][n] and GL[2k−1][n]) to each signal line 34.

In other words, the grayscale potential X[n] according to the grayscale GR[2k−1][n] based on the right-eye image GR is supplied to each pixel PIX with the positive polarity in the unit period U1 of the right-eye display period PR in the control period T1 and supplied to each pixel PIX with the negative polarity in the unit period U2 of the right-eye display period PR in the control period T2. In the same manner, the grayscale potential X[n] according to the grayscale GR[2k][n] based on the right-eye image GR is supplied to each pixel PIX with the negative polarity in the unit period U2 of the right-eye display period PR in the control period T1 and supplied to each pixel PIX with the positive polarity in the unit period U1 of the right-eye display period PR in the control period T2. Also for the grayscale potential X[n] according to the grayscales GL[2k−1][n] and GL[2k][n] based on the left-eye image GL, the opposite polarities are set over the lengths of time of the control period T1 and the control period T2.

Figure 11:
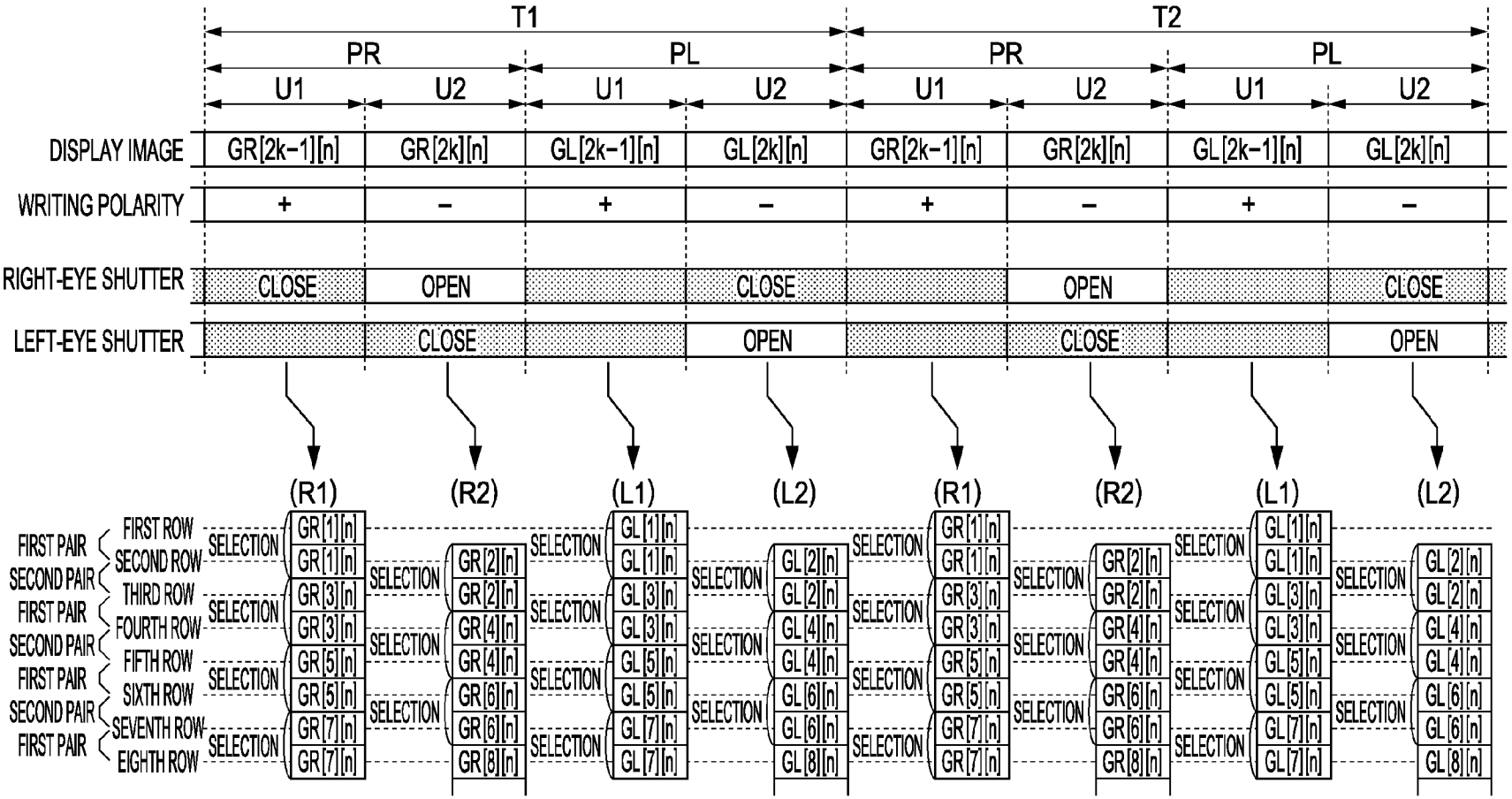
FIG. 11 is an illustrative diagram of an operation of Comparison Example 2.

However, as a form aiming to solve the problem (in other words, the problem of flickering that is easily perceived by an observer) that can occur in the first embodiment, it is possible to assume an embodiment in which the relationship between the unit period U1 or the unit period U2 of each display period P and a selection target (first pair or second pair) by the scanning line driving circuit 42 is the same in the control period T1 and the control period T2, and the polarity of the grayscale potential X[n] is set to be the positive polarity (+) in the unit period U1 of each display period P and to be the negative polarity (−) in the unit period U2 in both of the control period T1 and the control period T2 (hereinafter, referred to as "Comparison Example 2") as shown in FIG. 11. In the electro-optical device 10 according to Comparison Example 2, the polarity of the grayscale potential X[n] is reversed for each unit period U (U1 and U2) at all times, and any unit period U in which the grayscale potential X[n] is the same polarity is not continuous on the time axis. Accordingly, with the electro-optical device 10 according to the second embodiment, flickering caused by the difference in the polarities of the grayscale potential X[n] can be difficult to be perceived by an observer.

However, in Comparison Example 2, the grayscale potential X[n] according to the grayscale GR[2k−1][n] based on the right-eye image GR is set to be the positive polarity at all times, and the grayscale potential X[n] according to the grayscale GR[2k][n] based on the right-eye image GR is set to be the negative polarity at all times. Since the grayscale GR[2k−1][n] is generally different from the grayscale GR[2k][n], there is a possibility that unbalance of the polarity of a voltage (residual direct current components) applied to the liquid crystal element CL arises in Comparison Example 2. The same is applied to the left-eye image GL.

On the other hand, in the second embodiment, the grayscale potential X[n] according to the grayscale GR[2k−1][n] based on the right-eye image GR is set to be the positive polarity in the unit period U1 of the control period T1, and set to be the negative polarity in the unit period U2 of the control period T2. The length of time in which the grayscale potential X[n] is set to be the positive polarity and the length of time in which the grayscale potential is set to be the negative polarity are uniformized for the grayscale GR[2k][n] based on the right-eye image GL, the grayscale GL[2k−1][n] based on the left-eye image GL, and the grayscale GL[2k][n] based on the left-eye image GL. Therefore, in the electro-optical device 10 according to the second embodiment, there is an advantage in that the application of direct current components to the liquid crystal element CL is further reduced than in Comparison Example 2 (capable of suppressing deterioration of the liquid crystal element CL). In other words, according to the second embodiment, there is an advantage in that the effect of the first embodiment of suppressing the deterioration of the liquid crystal element CL caused by the application of direct current components and an effect of suppressing flickering caused by the difference in the polarities of the grayscale potential X[n] are compatible.

Modification Example

Each embodiment above can be variously modified. Specific modification embodiments will be exemplified below. Two or more embodiments arbitrarily selected from examples below can be arbitrarily combined within a scope in which they do not conflict with one another.

(1) Modification Example 1

In the first embodiment described above, the scanning line driving circuit 42 selects the scanning lines 32 in the (2k−1)-th row and the (2k)-th row constituting the first pair in the unit period U1 of each display period P, and selects the scanning lines 32 in the (2k)-th row and the (2k+1)-th row constituting the second pair in the unit period U2 of each display period P, but it is also possible to reverse the relationship between the unit period U1 or the unit period U2 and the selection target (the first pair or the second pair) by the scanning line driving circuit 42.

In other words, the scanning line driving circuit 42 may select the scanning lines 32 in the (2k)-th row and the (2k+1)-th row constituting the second pair in the unit period U1 of each display period P and may select the scanning lines 32 in the (2K−1)-th row and the (2k)-th row constituting the first pair in the unit period U2 of each display period P.

(2) Modification Example 2

In the embodiments and modification example described above, the right-eye shutter 22 is switched from a closed state to an open state at the ending point of the unit period U1 in the right-eye display period PR, but a period in which the right-eye shutter 22 is switched from a closed state to an open state is appropriately changed. For example, in a configuration in which the right-eye shutter 22 is switched to an open state before the ending point of the unit period U1 of the right-eye display period PR, the mixture of the right-eye image GR and the left-eye image GL in the unit period U1 is slightly perceived by an observer, but the brightness of a display image can improve. On the other hand, in a configuration in which the right-eye shutter 22 is switched to an open state at a time point after the ending point of the unit period U1 of the right-eye display period PR, the brightness of a display image is lowered, but perception of the mixture of the right-eye image GR and the left-eye image GL by an observer can be assuredly prevented. In the same manner, in a configuration in which a time to switch the right-eye shutter 22 from an open state to a closed state is set to be prior to the ending point of the unit period U2 of the right-eye display period PR (the brightness of a display image is lowered, but the mixture of the right-eye image GR and the left-eye image GL is prevented), and a configuration in which the time is set to be after the ending point of the unit period U2 of the right-eye display period PR (the mixture of the right-eye image GR and the left-eye image GL in the unit period U1 of the left-eye display period PL is slightly perceived, but the brightness of a display image improves) can also be employed. In addition, times of the open and closed states in which the mixture of the right-eye image GR and the left-eye image GL is difficult to be perceived by an observer also depend on the relationship of the response characteristic of the right-eye shutter 22 and the left-eye shutter 24 and the response characteristic of the electro-optical panel 12 (liquid crystal element CL). Thus, a time of switching the right-eye shutter 22 from a closed state to an open state and a time of switching the shutter from an open state to a closed state are determined in consideration of various factors such as priority (balance) between prevention of perception of the mixture of the right-eye image GR and the left-eye image GL by an observer and securing the brightness of a display image, or the relationship between the response characteristic of the stereoscopic vision glasses 20 and the response characteristic of the electro-optical panel 12. Note that the above description relates to the right-eye shutter 22, but the same is applicable to times of open and closed states of the left-eye shutter 24.

As understood from the above description, a period in which the right-eye shutter 22 is controlled to be in an open state is included as a period including at least a portion of the unit period U2 in the right-eye display period PR (regardless of the inclusion of the unit period U1). In the same manner, a period in which the left-eye shutter 24 is controlled to be in an open state is included as a period including at least a portion of the unit period U2 in the left-eye display period PL (regardless of the inclusion of the unit period U1). In addition, a period in which both of the right-eye shutter 22 and the left-eye shutter 24 are controlled to be in a closed state is included at least as a partial period of the unit period U1 in each display period P (PR and PL).

(3) Modification Example 3

In the embodiments and modification examples described above, the signal line driving circuit 44 is designed to commonly supply a grayscale potential X[n] according to a grayscale computed as the weighted average of a grayscale designated by the display data V for one pixel PIX out of two pixels PIX (selected pixels) which are adjacent to each other in the y direction and positioned in two rows simultaneously selected in each unit period U and a grayscale designated by the display data V for the other pixel PIX to each of the selected pixels, but the invention is not limited to the embodiments. When the difference between the grayscale designated by the display data V for one pixel PIX out of the selected pixels and the grayscale designated by the display data V for the other pixel PIX is greater than a predetermined threshold value α, the signal line driving circuit 44 supplies the grayscale potential X[n] according to the grayscale computed as the weighted average of the two grayscales commonly to each of the selected pixels, and when the difference between the grayscale designated by the display data V for one pixel PIX out of the selected pixels and the grayscale designated by the display data V for the other pixel PIX is equal to or smaller than the predetermined threshold value α, the signal line driving circuit supplies the grayscale potential X[n] according to the grayscale designated by the display data V for one pixel PIX out of the selected pixel commonly to each of the selected pixels.

Specifically, in each display period P (PR and PL) in each control period T (T1 and T2), in the selection period H in which the two scanning lines 32 in the (2k−1)-th row and the (2k)-th row constituting the first pair, when the difference between the grayscale (VR[2k−1][n] and VL[2k−1][n]) designated by the display data V (VR and VL) for a pixel PIX in the (2k−1)-th row and the n-th column and the grayscale (VR[2k][n] and VL[2k][n]) designated by the display data V for a pixel PIX in the (2k)-th row and the n-th column is greater than the threshold value α, the grayscale potential X[n] that the signal line driving circuit 44 outputs is set to be a value according to the grayscale (GR[2k−1][n] and GL[2k−1][n]) computed as the weighted average of the grayscale designated by the display data V for the pixel PIX in the (2k−1)-th row and the n-th column and the grayscale designated for the pixel PIX in the (2k)-th row and the n-th column. On the other hand, when the difference between the grayscale (VR[2k−1][n] and VL[2k−1][n]) designated by the display data V for the pixel PIX in the (2k−1)-th row and the n-th column and the grayscale (VR[2k][n] and VL[2k][n]) designated by the display data V for the pixel PIX in the (2k)-th row and the n-th column is equal to or smaller than the threshold value α, the grayscale potential X[n] that the signal line driving circuit 44 outputs is set to be a value according to the grayscale (VR[2k−1][n] and VL[2k−1][n]) designated by the display data V for the pixel PIX in the (2k−1)-th row and the n-th column.

In addition, in each display period P (PR and PL) in each control period T (T1 and T2), in the selection period H in which the two scanning lines 32 in the (2k)-th row and the (2k+1)-th row constituting the second pair, when the difference between the grayscale (VR[2k][n] and VL[2k][n]) designated by the display data V (VR and VL) for the pixel PIX in the (2k)-th row and the n-th column and the grayscale (VR[2k+1][n] and VL[2k+1][n]) designated by the display data V for a pixel PIX in the (2k+1)-th row and the n-th column is greater than the threshold value α, the grayscale potential X[n] that the signal line driving circuit 44 outputs is set to be a value according to the grayscale (GR[2k][n] and GL[2k][n]) computed as the weighted average of the grayscale designated by the display data V for the pixel PIX in the (2k)-th row and the n-th column and the grayscale designated for the pixel PIX in the (2k+1)-th row and the n-th column. On the other hand, when the difference between the grayscale (VR[2k][n] and VL[2k][n]) designated by the display data V for the pixel PIX in the (2k)-row and the n-th column and the grayscale (VR[2k+1][n] and VL[2k+1][n]) designated by the display data V for the pixel PIX in the (2k+1)-th row and the n-th column is equal to or smaller than the threshold value α, the grayscale potential X[n] that the signal line driving circuit 44 outputs is set to be a value according to the grayscale (VR[2k][n] and VL[2k][n]) designated by the display data V for the pixel PIX in the (2k)-th row and the n-th column.

In this manner, when the difference between the grayscale designated by the display data V for one pixel PIX out of the selected pixels and the grayscale designated by the display data V for the other pixel PIX is greater than the threshold value α, the electro-optical device 10 according to Modification Example 3 supplies the grayscale potential X[n] according to the grayscale computed as the weighted average of the two grayscales commonly to each of the selected pixels, and thus, the difference between the grayscale by which each pixel PIX is designated in the unit period U1 (first set grayscale) and the grayscale by which each pixel PIX is designated in the unit period U2 (second set grayscale) can be reduced. Accordingly, the electro-optical device 10 according to Modification Example 3 can lower the possibility that an observer perceives "flickering".

FIGS. 12A to 12C are illustrative diagrams showing the relationship between grayscales designated by the display data V supplied to the electro-optical device 10 according to Modification Example 3 and grayscales by which each pixel PIX is designated in each unit period U (U1 and U2). FIGS. 12A to 12C express the level of grayscales by which each pixel PIX is designated using gradation. Note that a case in which the display data V is the right-eye display data VR is exemplified below, but the description below is applicable also to a case in which the display data V is the left-eye display data VL in the same manner.

FIG. 12A shows a case in which, among grayscales designated by the display data V for each pixel PIX, the grayscales VR[6][3] and VR[5][4] are the minimum grayscales (black in the drawing), the grayscales VR[4][5] and VR[3][6] are the intermediate grayscales (gray in the drawing), and grayscale VR[m][n] other than them is the maximum grayscale (white in the drawing).

In this example, the threshold value α is set to be greater than the difference between the intermediate grayscale and the minimum grayscale (the difference between the maximum grayscale and the intermediate grayscale), and smaller than the difference between the maximum grayscale and the minimum grayscale. Thus, when one grayscale out of grayscales designated by the display data V for each of selected pixels is the minimum grayscale and the other one is the maximum grayscale, a grayscale potential X[n] according to the intermediate grayscale is supplied commonly to each of the selected pixels.

As shown in FIG. 12B, for example, to the two pixels PIX (selected pixels) positioned in the fifth row and the fourth column and in the sixth row and the fourth column, a grayscale potential X[n] according to the intermediate grayscale (GR[5][4]) computed as the average of the minimum grayscale (VR[5][4]) and the maximum grayscale (VR[6][4]) is supplied. In addition, to the two pixels PIX (selected pixels) positioned in the third row and the sixth column and in the fourth row and the sixth column, a grayscale potential X[n] according to the grayscale VR[3][6] that is the intermediate grayscale is supplied. In this manner, in the unit period U1, the grayscale by which each pixel PIX is designated is the maximum grayscale (white in the drawing) or the intermediate grayscale (gray in the drawing), and there is no pixel PIX of which the grayscale is designated to be the minimum grayscale (black in the drawing).

In the same manner, as shown in FIG. 12C, in the unit period U2, the grayscale by which each pixel PIX is designated is the maximum grayscale (white in the drawing) or the intermediate grayscale (gray in the drawing), and there is no pixel PIX of which the grayscale is designated to be the minimum grayscale (black in the drawing).

Therefore, the difference between the grayscale by which each pixel PIX is designated in the unit period U1 (first set grayscale) and the grayscale by which each pixel PIX is designated in the unit period U2 (second set grayscale) has a value smaller than the threshold value α, and brings an advantage that the occurrence of "flickering" caused by the difference between the first set grayscale and the second set grayscale can be suppressed.

(4) Modification Example 4

In the embodiments and modification examples described above, two weighting coefficients w used in the arithmetic operation of a weighted average for computing the image signal G from the display data V are set to be an equal value, but the invention is not limited thereto, and among the two weighting coefficients w, one may be set to be greater than the other.

If two weighting coefficients w used in the arithmetic operation of a weighted average for computing the image signal G from the display data V are set to be an equal value, there is a case in which the electro-optical device 10 displays an image having weaker contrast than an image based on the display data V. As shown in FIG. 13A, for example, when an image based on the display data V is an image displaying a black background and a white figure, and two weighting coefficients w are set to be an equal value, an image displayed by the electro-optical device 10 displays the figure in gray, which is supposed to be displayed in white.

The electro-optical device 10 according to Modification Example 4 determines two weighting coefficients used in the arithmetic operation of the weighted average for computing the grayscales of the selected pixels based on the relationship between the grayscale designated by the display data V for the selected pixels and the grayscale designated by the display data V for a plurality of pixels PIX present in the periphery of the selected pixels. In other words, the electro-optical device 10 according to Modification Example 4 controls the grayscales of the selected pixels based on the relationship between the grayscales of the selected pixels and the grayscale of the plurality of pixels PIX present in the periphery of the selected pixels. Accordingly, the electro-optical device 10 according to Modification Example 4 can display a clear-cut image that is close to the original display image based on the display data V.

When, for example, out of the selected pixels (two pixels PIX which are adjacent to each other in the y direction and positioned in two rows simultaneously selected in each unit period U (U1 and U2)), the grayscale designated by the display data V for one pixel PIX is a value greater than a predetermined grayscale, the grayscale designated by the display data V for the other pixel PIX is a value smaller than the predetermined grayscale, and the grayscale designated by the display data V for each of the plurality of pixels PIX present in the periphery of the selected pixels is a value smaller than the predetermined grayscale, two weighting coefficients w may be determined so that each of the selected pixels displays a grayscale greater than the predetermined grayscale. In this case, out of the two weighting coefficients w, a weighting coefficient w corresponding to one pixel PIX is set to be a value greater than the other weighing coefficient w corresponding to the other pixel PIX.

On the contrary, when the grayscale designated by the display data V for one pixel PIX out of the selected pixels is a value smaller than the predetermined grayscale, the grayscale designated by the display data V for the other pixel PIX is a value greater than the predetermined grayscale, and the grayscale designated by the display data V for each of the plurality of pixels PIX present in the periphery of the selected pixels is a value greater than the predetermined grayscale, two weighting coefficients w may be determined so that each of the selected pixels displays a grayscale smaller than the predetermined grayscale. In this case, out of the two weighting coefficients w, a weighting coefficient w corresponding to one pixel PIX is set to be a value greater than the other weighing coefficient w corresponding to the other pixel PIX.

As above, according to Modification Example 4, the difference between the grayscale designated by the display data V for a pixel PIX and the grayscale designated for each of the plurality of pixels PIX present in the periphery of the foregoing pixel PIX is great, two weighting coefficients w are determined so that the pixel PIX and the plurality of pixels PIX present in the periphery of the pixel PIX display grayscales which are greatly different from each other. Accordingly, the pixel PIX can display a grayscale close to a grayscale designated by the display data V.

Hereinbelow, a specific example of a method for determining two weighting coefficients w will be shown.

First, the display control circuit 142 computes the average of grayscales (simple average) designated by the display data V for each of a predetermined number of pixels including selected pixels as an average grayscale VAVE. Herein, the predetermined number of pixels refers to a total number (2+p+q) of pixels PIX including the selected pixels, p pixels PIX which are adjacent to the selected pixels on the negative side of the y direction, and q pixels PIX which are adjacent to the selected pixels on the positive side of the y direction.

Note that p and q are natural numbers that are equal to or greater than 1, and may be appropriately determined so as to satisfy (2+p+q)<M. Of course, p and q may have an equal value.

Next, the display control circuit 142 computes a difference value ΔV1 between a grayscale (first grayscale) designated by the display data V for one pixel PIX (first pixel) out of the selected pixels and the average grayscale VAVE and a difference value ΔV2 between a grayscale (second grayscale) designated by the display data V for the other pixel PIX (second pixel) out of the selected pixels and the average grayscale VAVE. Then, when the absolute value of the difference value ΔV1 is greater than the absolute value of the difference value ΔV2, the weighting coefficient w corresponding to the pixel PIX (first pixel) is set to have a value greater than the weighting coefficient w corresponding to the other pixel PIX (second pixel). On the contrary, when the absolute value of the difference value ΔV2 is greater than the absolute value of the difference value ΔV1, the weighting coefficient w corresponding to the other pixel PIX (second pixel) is set to have a value greater than the weighting coefficient w corresponding to the pixel PIX (first pixel).

More specifically, in the unit period U1 of the right-eye display period PR in each control period T (T1 and T2), in the selection period H in which two scanning lines 32 in the (2k−1)-th row and the (2k)-th row constituting the first pair are selected, the display control circuit 142 first computes the average value VAVE of grayscales VR[2k−1−p][n] to VR[2k+q][n] designated by the right-eye display data VR for each of (2+p+q) pixels PIX in the (2k−1−p)-th row and the n-th column to the (2k+q)-th row and the n-th column. Next, a difference value Δ1 between the grayscale VR[2k−1][n] designated by the right-eye display data VR for the pixel PIX (first pixel) in the (2k−1)-th row and the n-th column and the average grayscale VAVE and a difference value Δ2 between the grayscale VR[2k][n] designated by the right-eye display data VR for the pixel PIX (second pixel) in the (2k)-th row and the n-th column and the average grayscale VAVE are computed. Then, when the absolute value of the difference value Δ1 is a value greater than the absolute value of the difference value Δ2, the weighting coefficient $w_{2k-1}$ (first weighting coefficient) appearing in Formula (1) above is set to be a value greater than the weighting coefficient $w_{2k}$ (second weighting coefficient). On the contrary, when the absolute value of the difference value Δ2 is a value greater than the absolute value of the difference value Δ1, the weighting coefficient $w_{2k}$ (second weighting coefficient) is set to be a value greater than the weighting coefficient $w_{2k-1}$ (first weighting coefficient).

The weighting coefficient w is determined also in Formulas (2) to (4) in the same method as Formula (1). In other words, the display control circuit 142 determines the first weighting coefficient $w_{2k+1}$ and the second weighting coefficient $w_{2k}$ appearing in Formula (2) based on the magnitude relationship between the absolute value of the difference value Δ1 between the grayscale VR [2k+1][n] and the average grayscale VAVE and the absolute value of the difference value Δ2 between the grayscale VR [2k][n] and the average grayscale VAVE. In addition, the first weighting coefficient $w_{2k-1}$ and the second weighting coefficient $w_{2k}$ appearing in Formula (3) are determined based on the magnitude relationship between the absolute value of the difference value Δ1 between the grayscale VL [2k−1][n] and the average grayscale VAVE and the absolute value of the difference value Δ2 between the grayscale VL [2k][n] and the average grayscale VAVE. In the same manner, the first weighting coefficient $w_{2k+1}$ and the second weighting coefficient $w_{2k}$ appearing in Formula (4) are determined based on the magnitude relationship between the absolute value of the difference value Δ1 between the grayscale VL [2k+1][n] and the average grayscale VAVE and the absolute value of the difference value Δ2 between the grayscale VL [2k][n] and the average grayscale VAVE.

FIGS. 13A to 13C and 14 are illustrative diagrams showing the relationship between the grayscales designated by the display data V (for example, the right-eye display data VR) supplied to the electro-optical device according to Modification Example 4 and an image perceived by an observer. In this example, a case is assumed in which two weighting coefficients w used in the arithmetic operation of the weighted average are determined based on grayscales designated by the display data V for six pixels PIX including selected pixels (the selected pixels, two pixels PIX that are adjacent to the selected pixels on the negative side of the y direction, and two pixels PIX that are adjacent to the selected pixels on the positive side of the y direction).

FIGS. 13A to 13C are illustrative diagrams showing the level of gradation by which each pixel PIX is designated using gradation in the same manner as in FIGS. 5A to 5C. As shown in FIG. 13A, grayscales designated by the right-eye display data VR, the grayscales VR[3][6], VR[4][5], VR[5][4], and VR[6][3] are set to be the maximum grayscale (white in the drawing) and the rest grayscales are set to be the minimum grayscale (black in the drawing).

In this case, as shown in FIG. 13B, in the unit period U1, to two pixels (selected pixels) positioned in the fifth and sixth rows among the pixels positioned in the fourth column, a grayscale potential X[n] according to the grayscale GR[5][4] computed as the weighted average of the grayscale VR[5][4] and the grayscale [6][4] is supplied. With respect to the average grayscale VAVE of the grayscales VR[3][4] to VR[6][4], the difference value Δ1 between the average grayscale VAVE and the grayscale VR[5][4] is greater than the difference value Δ2 between the average grayscale VAVE and the grayscale VR[6][4]. Thus, in the arithmetic operation of the weighted average, the weighting coefficient $w_5$ corresponding to the grayscale VR[5][4] is set to be a value greater than the weighting coefficient $w_6$ corresponding to the grayscale VR[6][4]. As a result, the grayscale GR[5][4] is set to be a grayscale closer to the grayscale VR[5][4] than to the grayscale VR[6][4], in other words, a grayscale close to the maximum grayscale that is greater than the intermediate grayscale.

In the same manner, as shown in FIG. 13C, in the unit period U2, to two pixels PIX (selected pixels) positioned in the fourth and the fifth rows among the pixels PIX positioned in the fourth column, grayscale potential X[n] according to the grayscale GR[5][4] set to be a grayscale close to the maximum grayscale that is greater than the intermediate grayscale is supplied.

Figure 14:
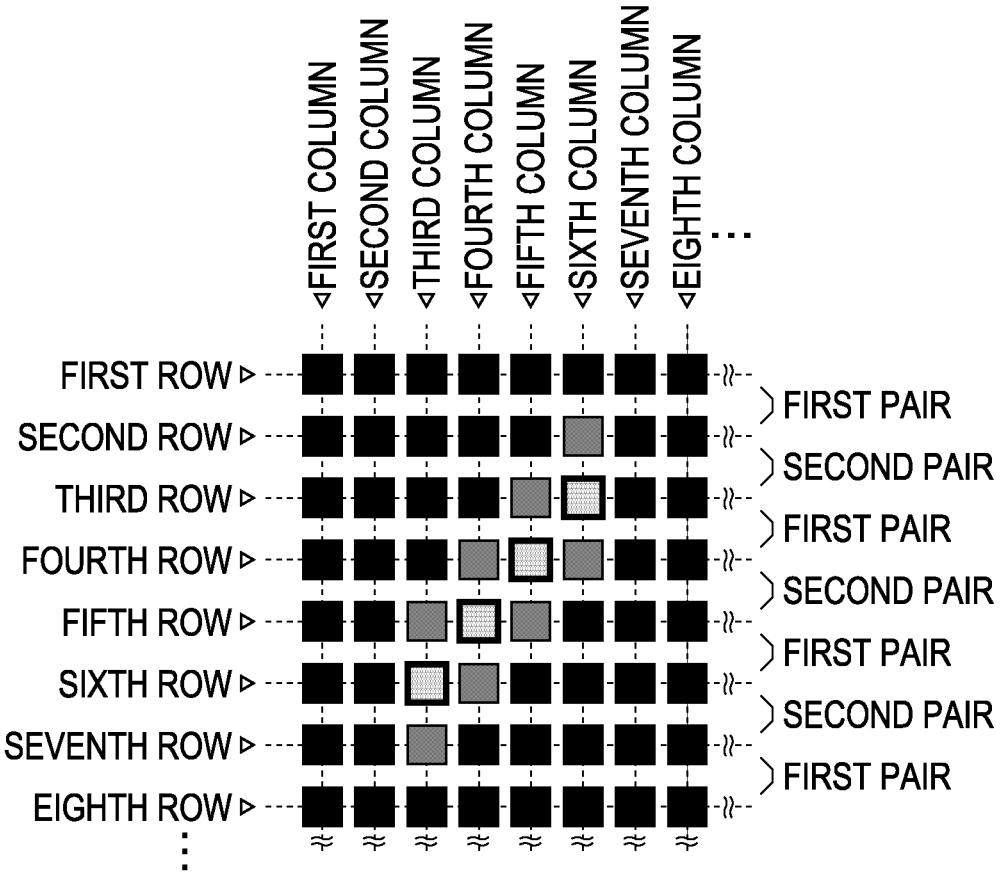
FIG. 14 is an illustrative diagram indicating grayscales that an observer perceives in the fourth modification example.

FIG. 14 is a diagram showing an image perceived by an observer in the unit period U2, that is, an image in which an image displayed in the unit period U1 and an image displayed in the unit period U2 are mixed. As shown in FIG. 14, the observer perceives four pixels PIX in the third row and the sixth column, the fourth row and the fifth column, the fifth row and the fourth column, and the sixth row and the third column as pixels expressing grayscales close to the maximum grayscale that is greater than the intermediate grayscale. In this way, according to Modification Example 4, the observer can perceive a clear-cut image that is close to the image based on the display data V.

(5) Modification Example 5

In the embodiments and modification examples described above, a grayscale potential X[n] according to a grayscale computed as the average (weighted average) of a grayscale designated by the display data V for one pixel PIX out of selected pixels and a grayscale designated by the display data V for the other pixel PIX is supplied commonly to each of the selected pixels, but the invention is not limited thereto, and a grayscale potential X[n] according to a grayscale obtained by multiplying a coefficient (grayscale control coefficient ρ) by a value obtained by simply averaging the grayscale designated by the display data V for one pixel PIX out of the selected pixels and the grayscale designated by the display data V for the other pixel PIX may be supplied commonly to each of the selected pixels.

For example, when a grayscale designated by the display data V for one pixel PIX out of selected pixels is a value greater than the predetermined grayscale, a grayscale designated by the display data V for the other pixel PIX is a value smaller than the predetermined grayscale, and a grayscale designated by the display data V for each of a plurality pixels PIX present in the periphery of the selected pixels is a value smaller than the predetermined grayscale, the grayscale control coefficient ρ is set to be a value greater than "1". In addition, a grayscale potential X[n] according to a grayscale obtained by multiplying the grayscale control coefficient ρ by a value obtained by averaging (performing simple averaging) the grayscale designated by the display data V for the pixel PIX out of the selected pixels and grayscale designated by the display data V for the other pixel PIX is supplied commonly to each of the selected pixels.

On the contrary, when the grayscale designated by the display data V for one pixel PIX out of the selected pixels is a value smaller than the predetermined grayscale, the grayscale designated by the display data V for the other pixel PIX is a value greater than the predetermined grayscale, and the grayscale designated by the display data V for each of the plurality pixels PIX present in the periphery of the selected pixels is a value greater than the predetermined grayscale, the grayscale control coefficient ρ is set to be a value greater than "0" and smaller than "1". In addition, a grayscale potential X[n] according to a grayscale obtained by multiplying the grayscale control coefficient ρ by a value obtained by averaging (performing simple averaging) the grayscale designated by the display data V for the pixel PIX out of the selected pixels and grayscale designated by the display data V for the other pixel PIX is supplied commonly to each of the selected pixels.

Hereinbelow, a specific example of a method for determining a grayscale control coefficient ρ will be described.

First, the display control circuit 142 computes the average (simple average) of grayscales designated by the display data V for each of (2+p+q) pixels PIX (a predetermined number of pixels) positioned in the same row including selected pixels as the average grayscale VAVE. Next, a difference value ΔV1 between a grayscale (first grayscale) designated by the display data V for one pixel PIX (first pixel) out of the selected pixels and the average grayscale VAVE and a difference value ΔV2 between a grayscale (second grayscale) designated by the display data V for the other pixel PIX (second pixel) out of the selected pixels and the average grayscale VAVE are computed.

Then, when the absolute value of the difference value ΔV1 is a value greater than the absolute value of the difference value ΔV2, and the grayscale (first grayscale) designated by the display data V for the pixel PIX (first pixel) is a value greater than the average grayscale VAVE, the display control circuit 142 sets the grayscale control coefficient ρ to be a value greater than "1". In addition, when the absolute value of the difference value ΔV2 is a value greater than the absolute value of the difference value ΔV1, and the grayscale (second grayscale) designated by the display data V for the other pixel PIX (second pixel) is a value greater than the average grayscale VAVE, the display control circuit 142 sets the grayscale control coefficient ρ to be a value greater than "1". Then, the signal line driving circuit 44 supplies a grayscale potential X[n] according to a grayscale obtained by multiplying the grayscale control coefficient ρ by a value obtained by averaging the grayscale designated by the display data V for the pixel PIX out of the selected pixels and the grayscale designated by the display data V for the other pixel PIX commonly to each of the selected pixels.

On the contrary, when the absolute value of the difference value ΔV1 is a value greater than the absolute value of the difference value ΔV2, and the grayscale (first grayscale) designated by the display data V for the pixel PIX (first pixel) is a value smaller than the average grayscale VAVE, the display control circuit 142 sets the grayscale control coefficient ρ to be a value greater than "0" and smaller than "1". In addition, when the absolute value of the difference value ΔV2 is a value greater than the absolute value of the difference value ΔV1, and the grayscale (second grayscale) designated by the display data V for the other pixel PIX (second pixel) is a value smaller than the average grayscale VAVE, the display control circuit 142 sets the grayscale control coefficient ρ to be a value greater than "0" and smaller than "1". Then, the signal line driving circuit 44 supplies a grayscale potential X[n] according to a grayscale obtained by multiplying the grayscale control coefficient ρ by a value obtained by averaging the grayscale designated by the display data V for the pixel PIX out of the selected pixels and the grayscale designated by the display data V for the other pixel PIX commonly to each of the selected pixels.

In this way, the electro-optical device 10 according to Modification Example 5 controls the grayscales of the selected pixels based on the relationship between the grayscales of the selected pixels and the grayscales of the plurality of pixels PIX present in the periphery of the selected pixels. Accordingly, it is possible to display a clear-cut image close to the original display image expressed based on the display data V.

(6) Modification Example 6

An electro-optical element is not limited to the liquid crystal element CL. For example, an electrophoresis element can also be used as an electro-optical element. In other words, the electro-optical element is included as a display element of which optical characteristics (for example, transmittance) change according to an electronic action (for example, application of a voltage).

Application Example

Figure 15:
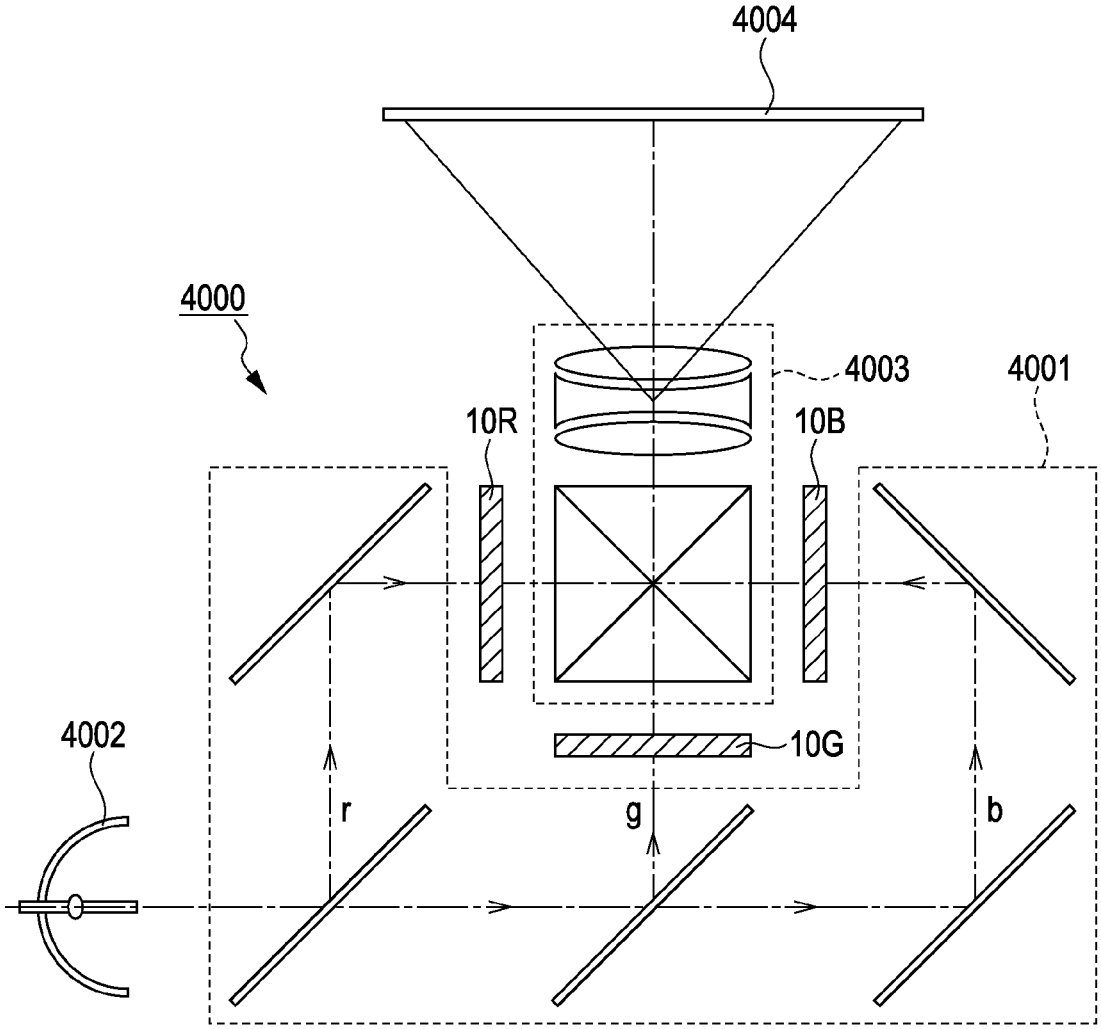
FIG. 15 is a perspective view of an electronic apparatus (projective display apparatus).
Figure 16:
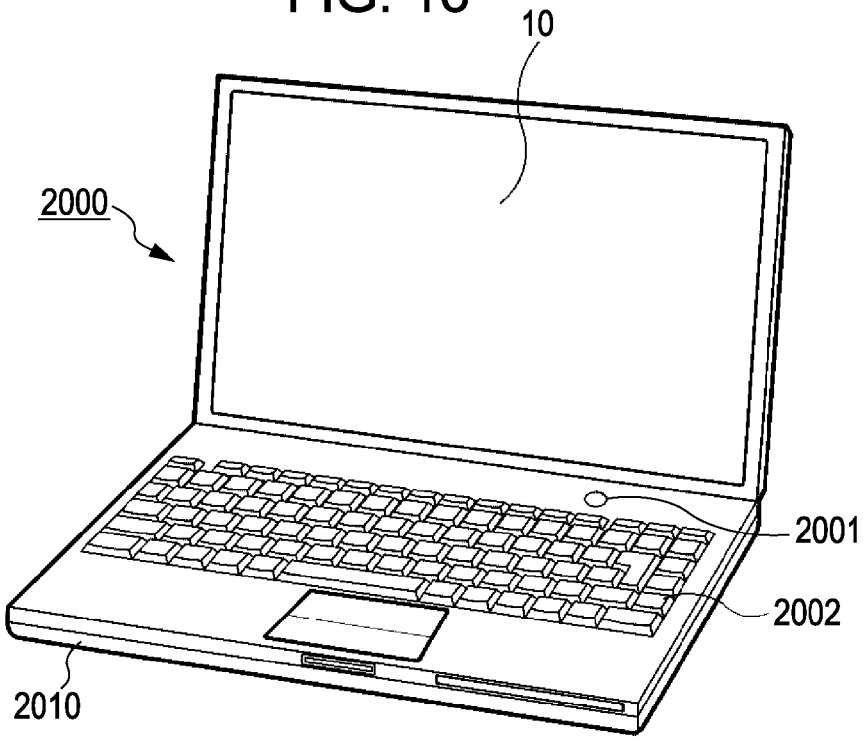
FIG. 16 is a perspective view of an electronic apparatus (personal computer).
Figure 17:
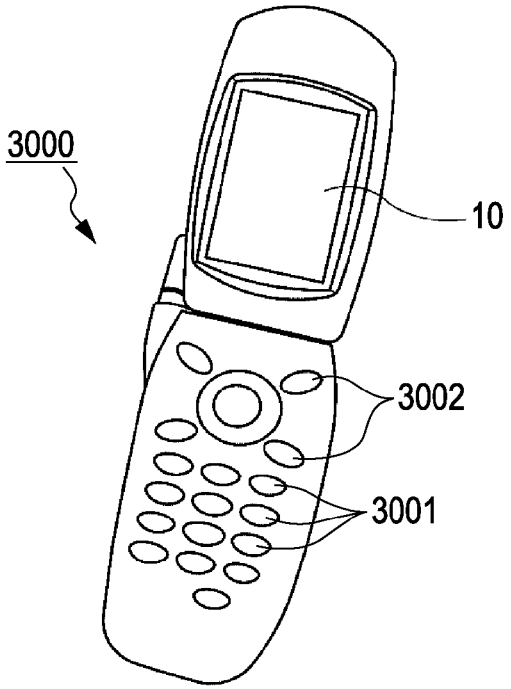
FIG. 17 is a perspective view of an electronic apparatus (mobile telephone).
Figure 18:
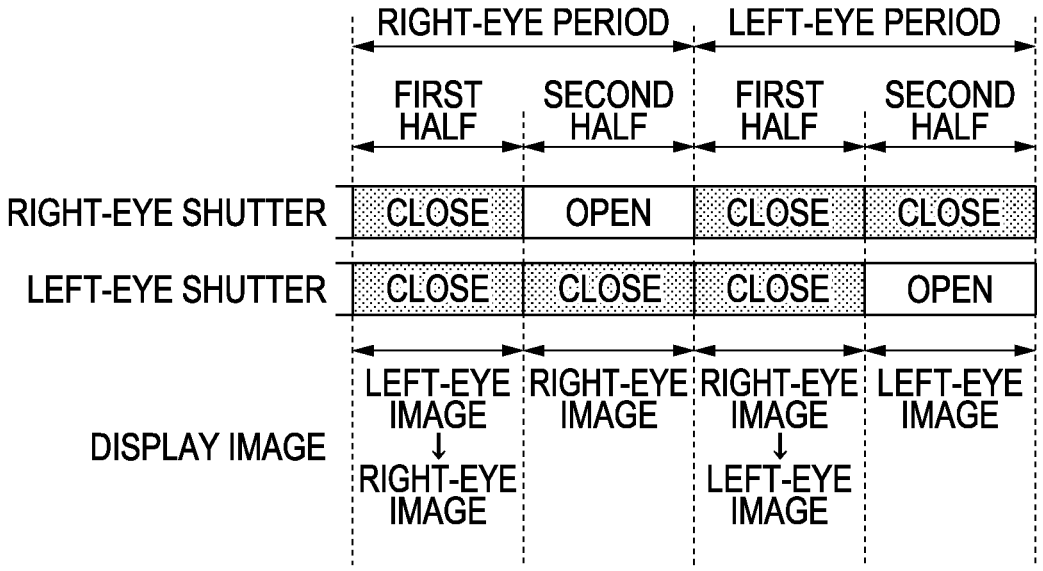
FIG. 18 is an illustrative diagram of an operation of stereoscopic view in the related art.

The electro-optical device 10 exemplified in each embodiment above can be used in various kinds of electronic apparatus. FIGS. 15 to 17 exemplify specific forms of electronic apparatus in which the electro-optical device 10 is adopted.

FIG. 15 is a schematic diagram of a projection type display apparatus (three-plate type projector) 4000 to which the electro-optical device 10 is applied. The projection type display device 4000 is configured to include three electro-optical devices 10 (10R, 10G, and 10B) corresponding to display colors (red, green, and blue) different from one another. An illumination optical system 4001 supplies a red component r in light emitted from an illumination device (light source) 4002 to the electro-optical device 10R, a green component g to the electro-optical device 10G, and a blue component b to the electro-optical device 10B. Each of the electro-optical devices 10 functions as light modulators (light valves) which modulates each plain-color light beams supplied from the illumination optical system 4001 in accordance with a display image. A projection optical system 4003 synthesizes light beams emitted from each of the electro-optical devices 10 and then projects them to a projection plane 4004. An observer visually recognizes a stereoscopic image projected on the projection plane 4004 using the stereoscopic vision glasses 20 (which is omitted in FIG. 15).

FIG. 16 is a perspective view of a portable personal computer to which the electro-optical device 10 is applied. The personal computer 2000 includes the electro-optical device 10 for displaying various images and a main body unit 2010 provided with a power supply switch 2001 and a keyboard 2002.

FIG. 17 is a perspective view of a mobile telephone to which the electro-optical device 10 is applied. The mobile telephone 3000 includes a plurality of operation buttons 3001, scroll buttons 3002, and the electro-optical device 10 for displaying various images. By operating the scroll buttons 3002, the screen displayed on the electro-optical device 10 is scrolled.

As electronic apparatus to which the electro-optical device according to an aspect of the invention is applied, in addition to the devices exemplified in FIGS. 15 to 17, portable information terminals (PDA: Personal Digital Assistants), digital still cameras, televisions, video cameras, car navigation systems, display units in vehicles (instrument panel), electronic organizers, electronic paper, calculators, word processors, work stations, video telephones, POS terminals, printers, scanners, copying machines, video players, equipment including a touch panel, and the like can be exemplified.

This application claims priority to Japan Patent Application No. 2011-261718 filed Nov. 30, 2011, the entire disclosures of which are hereby incorporated by reference in their entireties.

What is claimed is:

1. An electro-optical device that alternately displays a right-eye image and a left-eye image in each display period comprising:

a plurality of scanning lines that includes a plurality of first scanning lines and a plurality of second scanning lines that are alternately arranged;

a plurality of signal lines that intersects with the plurality of scanning lines;

a plurality of pixels each of which is disposed at each intersection of the plurality of scanning lines and the plurality of signal lines;

a first driving circuit that, in respective display periods of a right-eye image and a left-eye image, sequentially selects scanning lines of a first pair including a first scanning line and a second scanning line out of the plurality of scanning lines which are adjacent to each other in each selection period of a first unit period of the display period, and sequentially selects scanning lines of a second pair including a first scanning line and a second scanning line which are adjacent to each other in a combination in which one of the scanning lines of the first pair selected in the first unit period straddles the second pair in each selection period of a second unit period after the elapse of the first unit period; and a second driving circuit to which display data indicating grayscales to be displayed in each of the plurality of pixels is supplied, and which, when a grayscale designated by the display data for a first pixel corresponding to each first scanning line is set to be a first grayscale and a grayscale designated by the display data for a second pixel corresponding to each second scanning line is set to be a second grayscale out of the scanning lines of the first pair and the scanning lines of the second pair selected by the first driving circuit in each of the selection periods, supplies a grayscale potential according to a grayscale computed as a weighted average of the first grayscale and the second grayscale to the first pixel and the second pixel, wherein, in each of a plurality of control periods including a display period of a right-eye image and a display period of a left-eye image which are consecutive, the first driving circuit sequentially selects the scanning lines of the first pair including a first scanning line and a second scanning line out of the plurality of scanning lines which are adjacent to each other in each selection period of the first unit period of each of the display periods, and sequentially selects the scanning lines of the second pair including a first scanning line and a second scanning line out of the plurality of scanning lines which are adjacent to each other in a combination in which one of the scanning lines of the first pair straddles the second pair in each selection period of a second unit period of each of the display periods, and wherein, in a first control period of each of the display periods in the plurality of control periods, the second driving circuit sets the polarity of the grayscale potential with respect to a reference voltage to be a first polarity in the first unit period of each of the display periods and to be a second polarity that is the opposite polarity to the first polarity in the second unit period of each of the display periods, and in a second control period immediately after the first control period of the plurality of control periods, sets the polarity of the grayscale potential with respect to the reference potential to be the second polarity in the first unit period of each of the display periods and to be the first polarity in the second unit period of each of the display periods.

2. The electro-optical device according to claim 1, wherein, in an arithmetic operation of the weighted average, a first weighting coefficient given to the first grayscale and a second weighting coefficient given to the second grayscale are greater than 0.

3. The electro-optical device according to claim 2, wherein the first weighting coefficient and the second weighting coefficient are an equal value.

4. The electro-optical device according to claim 2, wherein, when the display data has the average value of grayscales designated for each of a predetermined number of pixels including the first pixel and the second pixel as an average grayscale, if the difference between the first grayscale and the average grayscale is greater than the difference between the second grayscale and the average grayscale, the first weighting coefficient is set to be a value greater than the second weighting coefficient, and if the difference between the first grayscale and the average grayscale is smaller than the difference between the second grayscale and the average grayscale, the first weighting coefficient is set to be a value smaller than the second weighting coefficient.

5. The electro-optical device according to claim 4, wherein the predetermined number of pixels includes at least one or more pixels which are adjacent to the second pixel on the opposite side of an extending direction of the first pixel and a signal line, and at least one or more pixels which are adjacent to the first pixel on the opposite side of an extending direction of the second pixel and a signal line.

6. The electro-optical device according to claim 1, which displays a right-eye image and a left-eye image stereoscopically viewed using stereoscopic vision glasses including a right-eye shutter and a left-eye shutter, further comprising:

a glasses control circuit that controls both of the right-eye shutter and the left-eye shutter to be in a closed state during a period at least including a portion of the first unit period of each of the display periods, controls the right-eye shutter to be in an open state and the left-eye shutter to be in a closed state during a period at least including a portion of the second unit period in each display period of the right-eye image, and controls the left-eye shutter to be in an open state and the right-eye shutter to be in a closed state during a period at least including a portion of the second unit period in each display period of the left-eye period.

7. The electro-optical device according to claim 1, wherein, in a first control period of a plurality of control periods including a display period of a right-eye image and a display period of a left-eye image which are consecutive, the first driving circuit sequentially selects the scanning lines of the first pair including a first scanning line and a second scanning line out of the plurality of scanning lines which are adjacent to each other in each selection period of the first unit period of each of the display periods, and sequentially selects scanning lines of the second pair including a first scanning line and a second scanning line out of the plurality of scanning lines which are adjacent to each other in a combination in which one of the scanning lines of the first pair straddles the second pair in each selection period of the second unit period of each of the display periods, and in a second control period immediately after the first control period of the plurality of control periods, sequentially selects the scanning lines of the second pair in each selection period of the first unit period of each of the display periods, and sequentially selects the scanning lines of the first pair in each selection period of the second unit period of each of the display periods, and wherein the second driving circuit sets the polarity of the grayscale potential with respect to the reference potential to be a first polarity in the first unit period of each of the display periods, and sets the polarity of the grayscale potential to be a second polarity that is the opposite polarity to the first polarity in the second unit period of each of the display periods in each of the plurality of control periods.

8. An electro-optical device that alternately displays a right-eye image and a left-eye image in each display period comprising:

a plurality of scanning lines that includes a plurality of first scanning lines and a plurality of second scanning lines that are alternately arranged;

a plurality of signal lines that intersects with the plurality of scanning lines;

a plurality of pixels each of which is disposed at each intersection of the plurality of scanning lines and the plurality of signal lines;

a first driving circuit that, in respective display periods of a right-eye image and a left-eye image, sequentially selects scanning lines of a first pair including a first scanning line and a second scanning line out of the plurality of scanning lines which are adjacent to each other in each selection period of a first unit period of the display period, and sequentially selects scanning lines of a second pair including a first scanning line and a second scanning line which are adjacent to each other in a combination in which one of the scanning lines of the first pair selected in the first unit period straddles the second pair in each selection period of a second unit period after the elapse of the first unit period; and a second driving circuit to which display data indicating grayscales to be displayed in each of the plurality of pixels is supplied, and which, when a grayscale designated by the display data for a first pixel corresponding to each first scanning line is set to be a first grayscale, a grayscale designated by the display data for a second pixel corresponding to each second scanning line is set to be a second grayscale out of the scanning lines of the first pair and the scanning lines of the second pair selected by the first driving circuit in each of the selection periods, and the average value of grayscales designated by the display data for each of a predetermined number of pixels including the first pixel and the second pixel is set to be an average grayscale, supplies a grayscale potential according to a grayscale computed by multiplying the average value of the first grayscale and the second grayscale by a grayscale control coefficient determined based on the first grayscale, the second grayscale, and the average grayscale to the first pixel and the second pixel, wherein, in each of a plurality of control periods including a display period of a right-eye image and a display period of a left-eye image which are consecutive, the first driving circuit sequentially selects the scanning lines of the first pair including a first scanning line and a second scanning line out of the plurality of scanning lines which are adjacent to each other in each selection period of the first unit period of each of the display periods, and sequentially selects the scanning lines of the second pair including a first scanning line and a second scanning line out of the plurality of scanning lines which are adjacent to each other in a combination in which one of the scanning lines of the first pair straddles the second pair in each selection period of a second unit period of each of the display periods, and wherein, in a first control period of each of the display periods in the plurality of control periods, the second driving circuit sets the polarity of the grayscale potential with respect to a reference voltage to be a first polarity in the first unit period of each of the display periods and to be a second polarity that is the opposite polarity to the first polarity in the second unit period of each of the display periods, and in a second control period immediately after the first control period of the plurality of control periods, sets the polarity of the grayscale potential with respect to the reference potential to be the second polarity in the first unit period of each of the display periods and to be the first polarity in the second unit period of each of the display periods.

9. The electro-optical device according to claim 8, wherein, when the difference between the first grayscale and the average grayscale is greater than the difference between the second grayscale and the average grayscale, the grayscale control coefficient is set to be a value greater than 1 if the first grayscale is greater than the average grayscale, and the grayscale control coefficient is set to be a value greater than 0 and smaller than 1 if the first grayscale is smaller than the average grayscale, and wherein, when the difference between the second grayscale and the average grayscale is greater than the difference between the first grayscale and the average grayscale, the grayscale control coefficient is set to be a value greater than 1 if the second grayscale is greater than the average grayscale, and the grayscale control coefficient is set to be a value greater than 0 and smaller than 1 if the second grayscale is smaller than the average grayscale.

10. An electro-optical device that alternately displays a right-eye image and a left-eye image in each display period comprising:

a plurality of scanning lines that includes a plurality of first scanning lines and a plurality of second scanning lines that are alternately arranged;

a plurality of signal lines that intersects with the plurality of scanning lines;

a plurality of pixels each of which is disposed at each intersection of the plurality of scanning lines and the plurality of signal lines;

a first driving circuit that, in respective display periods of a right-eye image and a left-eye image, sequentially selects scanning lines of a first pair including a first scanning line and a second scanning line out of the plurality of scanning lines which are adjacent to each other in each selection period of a first unit period of the display period, and sequentially selects scanning lines of a second pair including a first scanning line and a second scanning line which are adjacent to each other in a combination in which one of the scanning lines of the first pair selected in the first unit period straddles the second pair in each selection period of a second unit period after the elapse of the first unit period; and a second driving circuit to which display data indicating grayscales to be displayed in each of the plurality of pixels is supplied, and which, when a grayscale designated by the display data for a first pixel corresponding to each first scanning line is set to be a first grayscale, a grayscale designated by the display data for a second pixel corresponding to each second scanning line is set to be a second grayscale out of the scanning lines of the first pair and the scanning lines of the second pair selected by the first driving circuit in each of the selection periods, and the difference between the first grayscale and the second grayscale is greater than a predetermined threshold value, supplies a grayscale potential according to a grayscale computed as the weighted average of the first grayscale and the second grayscale to the first pixel and the second pixel, and when the difference between the first grayscale and the second grayscale is equal to or smaller than the predetermined threshold value, supplies a grayscale potential according to the first grayscale to the first pixel and the second pixel, wherein, in each of a plurality of control periods including a display period of a right-eye image and a display period of a left-eye image which are consecutive, the first driving circuit sequentially selects the scanning lines of the first pair including a first scanning line and a second scanning line out of the plurality of scanning lines which are adjacent to each other in each selection period of the first unit period of each of the display periods, and sequentially selects the scanning lines of the second pair including a first scanning line and a second scanning line out of the plurality of scanning lines which are adjacent to each other in a combination in which one of the scanning lines of the first pair straddles the second pair in each selection period of a second unit period of each of the display periods, and wherein, in a first control period of each of the display periods in the plurality of control periods, the second driving circuit sets the polarity of the grayscale potential with respect to a reference voltage to be a first polarity in the first unit period of each of the display periods and to be a second polarity that is the opposite polarity to the first polarity in the second unit period of each of the display periods, and in a second control period immediately after the first control period of the plurality of control periods, sets the polarity of the grayscale potential with respect to the reference potential to be the second polarity in the first unit period of each of the display periods and to be the first polarity in the second unit period of each of the display periods.

11. An electro-optical device that alternately displays a right-eye image and a left-eye image in each display period comprising:

a plurality of scanning lines that includes a plurality of first scanning lines and a plurality of second scanning lines that are alternately arranged;

a plurality of signal lines that intersects with the plurality of scanning lines;

a plurality of pixels each of which is disposed at each intersection of the plurality of scanning lines and the plurality of signal lines;

a first driving circuit that, in respective display periods of a right-eye image and a left-eye image, sequentially selects scanning lines of a first pair including a first scanning line and a second scanning line out of the plurality of scanning lines which are adjacent to each other in each selection period of a first unit period of the display period, and sequentially selects scanning lines of a second pair including a first scanning line and a second scanning line which are adjacent to each other in a combination in which one of the scanning lines of the first pair selected in the first unit period straddles the second pair in each selection period of a second unit period after the elapse of the first unit period; and a second driving circuit to which display data indicating grayscales to be displayed in each of the plurality of pixels is supplied, and which, when a grayscale designated by the display data for a first pixel corresponding to each first scanning line is set to be a first grayscale and a grayscale designated by the display data for a second pixel corresponding to each second scanning line is set to be a second grayscale out of the scanning lines of the first pair and the scanning lines of the second pair selected by the first driving circuit in each of the selection periods, supplies a grayscale potential according to a grayscale computed as a weighted average of the first grayscale and the second grayscale to the first pixel and the second pixel, wherein, in a first control period of a plurality of control periods including a display period of a right-eye image and a display period of a left-eye image which are consecutive, the first driving circuit sequentially selects the scanning lines of the first pair including a first scanning line and a second scanning line out of the plurality of scanning lines which are adjacent to each other in each selection period of the first unit period of each of the display periods, and sequentially selects scanning lines of the second pair including a first scanning line and a second scanning line out of the plurality of scanning lines which are adjacent to each other in a combination in which one of the scanning lines of the first pair straddles the second pair in each selection period of the second unit period of each of the display periods, and in a second control period immediately after the first control period of the plurality of control periods, sequentially selects the scanning lines of the second pair in each selection period of the first unit period of each of the display periods, and sequentially selects the scanning lines of the first pair in each selection period of the second unit period of each of the display periods, and wherein the second driving circuit sets the polarity of the grayscale potential with respect to a reference potential to be a first polarity in the first unit period of each of the display periods, and sets the polarity of the grayscale potential to be a second polarity that is the opposite polarity to the first polarity in the second unit period of each of the display periods in each of the plurality of control periods.

12. An electro-optical device that alternately displays a right-eye image and a left-eye image in each display period comprising:

a plurality of scanning lines that includes a plurality of first scanning lines and a plurality of second scanning lines that are alternately arranged;

a plurality of signal lines that intersects with the plurality of scanning lines;

a plurality of pixels each of which is disposed at each intersection of the plurality of scanning lines and the plurality of signal lines;

a first driving circuit that, in respective display periods of a right-eye image and a left-eye image, sequentially selects scanning lines of a first pair including a first scanning line and a second scanning line out of the plurality of scanning lines which are adjacent to each other in each selection period of a first unit period of the display period, and sequentially selects scanning lines of a second pair including a first scanning line and a second scanning line which are adjacent to each other in a combination in which one of the scanning lines of the first pair selected in the first unit period straddles the second pair in each selection period of a second unit period after the elapse of the first unit period; and a second driving circuit to which display data indicating grayscales to be displayed in each of the plurality of pixels is supplied, and which, when a grayscale designated by the display data for a first pixel corresponding to each first scanning line is set to be a first grayscale, a grayscale designated by the display data for a second pixel corresponding to each second scanning line is set to be a second grayscale out of the scanning lines of the first pair and the scanning lines of the second pair selected by the first driving circuit in each of the selection periods, and the average value of grayscales designated by the display data for each of a predetermined number of pixels including the first pixel and the second pixel is set to be an average grayscale, supplies a grayscale potential according to a grayscale computed by multiplying the average value of the first grayscale and the second grayscale by a grayscale control coefficient determined based on the first grayscale, the second grayscale, and the average grayscale to the first pixel and the second pixel, wherein, in a first control period of a plurality of control periods including a display period of a right-eye image and a display period of a left-eye image which are consecutive, the first driving circuit sequentially selects the scanning lines of the first pair including a first scanning line and a second scanning line out of the plurality of scanning lines which are adjacent to each other in each selection period of the first unit period of each of the display periods, and sequentially selects scanning lines of the second pair including a first scanning line and a second scanning line out of the plurality of scanning lines which are adjacent to each other in a combination in which one of the scanning lines of the first pair straddles the second pair in each selection period of the second unit period of each of the display periods, and in a second control period immediately after the first control period of the plurality of control periods, sequentially selects the scanning lines of the second pair in each selection period of the first unit period of each of the display periods, and sequentially selects the scanning lines of the first pair in each selection period of the second unit period of each of the display periods, and wherein the second driving circuit sets the polarity of the grayscale potential with respect to a reference potential to be a first polarity in the first unit period of each of the display periods, and sets the polarity of the grayscale potential to be a second polarity that is the opposite polarity to the first polarity in the second unit period of each of the display periods in each of the plurality of control periods.

13. An electro-optical device that alternately displays a right-eye image and a left-eye image in each display period comprising:

a plurality of scanning lines that includes a plurality of first scanning lines and a plurality of second scanning lines that are alternately arranged;

a plurality of signal lines that intersects with the plurality of scanning lines;

a plurality of pixels each of which is disposed at each intersection of the plurality of scanning lines and the plurality of signal lines;

a first driving circuit that, in respective display periods of a right-eye image and a left-eye image, sequentially selects scanning lines of a first pair including a first scanning line and a second scanning line out of the plurality of scanning lines which are adjacent to each other in each selection period of a first unit period of the display period, and sequentially selects scanning lines of a second pair including a first scanning line and a second scanning line which are adjacent to each other in a combination in which one of the scanning lines of the first pair selected in the first unit period straddles the second pair in each selection period of a second unit period after the elapse of the first unit period; and a second driving circuit to which display data indicating grayscales to be displayed in each of the plurality of pixels is supplied, and which, when a grayscale designated by the display data for a first pixel corresponding to each first scanning line is set to be a first grayscale, a grayscale designated by the display data for a second pixel corresponding to each second scanning line is set to be a second grayscale out of the scanning lines of the first pair and the scanning lines of the second pair selected by the first driving circuit in each of the selection periods, and the difference between the first grayscale and the second grayscale is greater than a predetermined threshold value, supplies a grayscale potential according to a grayscale computed as the weighted average of the first grayscale and the second grayscale to the first pixel and the second pixel, and when the difference between the first grayscale and the second grayscale is equal to or smaller than the predetermined threshold value, supplies a grayscale potential according to the first grayscale to the first pixel and the second pixel wherein, in a first control period of a plurality of control periods including a display period of a right-eye image and a display period of a left-eye image which are consecutive, the first driving circuit sequentially selects the scanning lines of the first pair including a first scanning line and a second scanning line out of the plurality of scanning lines which are adjacent to each other in each selection period of the first unit period of each of the display periods, and sequentially selects scanning lines of the second pair including a first scanning line and a second scanning line out of the plurality of scanning lines which are adjacent to each other in a combination in which one of the scanning lines of the first pair straddles the second pair in each selection period of the second unit period of each of the display periods, and in a second control period immediately after the first control period of the plurality of control periods, sequentially selects the scanning lines of the second pair in each selection period of the first unit period of each of the display periods, and sequentially selects the scanning lines of the first pair in each selection period of the second unit period of each of the display periods, and wherein the second driving circuit sets the polarity of the grayscale potential with respect to a reference potential to be a first polarity in the first unit period of each of the display periods, and sets the polarity of the grayscale potential to be a second polarity that is the opposite polarity to the first polarity in the second unit period of each of the display periods in each of the plurality of control periods.

* * * * *